US006492102B1

(12) United States Patent
Kagawa et al.

(10) Patent No.: US 6,492,102 B1
(45) Date of Patent: Dec. 10, 2002

(54) SILVER HALIDE EMULSION AND SILVER HALIDE LIGHT SENSITIVE PHOTOGRAPHIC MATERIAL

(75) Inventors: Nobuaki Kagawa, Hino (JP); Noriyasu Kita, Hino (JP)

(73) Assignee: Konica Corporation (JP)

( * ) Notice: Subject to any disclaimer, the term of this patent is extended or adjusted under 35 U.S.C. 154(b) by 69 days.

(21) Appl. No.: 09/636,797

(22) Filed: Aug. 11, 2000

(30) Foreign Application Priority Data

Aug. 20, 1999 (JP) ..... 11-233956

(51) Int. Cl.[7] ..... G03C 1/08; G03C 1/09; G03C 1/34

(52) U.S. Cl. ..... 430/584; 430/559; 430/570; 430/573; 430/578; 430/581; 430/586; 430/583; 430/599; 430/600; 430/603; 430/607; 430/611; 430/613; 430/614

(58) Field of Search ..... 430/559, 570, 430/573, 578, 581, 586, 583, 599, 600, 603, 607, 611, 613, 614, 584

(56) References Cited

U.S. PATENT DOCUMENTS 5,998,125 A * 12/1999 Inagaki et al. ..... 430/584

FOREIGN PATENT DOCUMENTS

| | | | |
|---|---|---|---|
| JP | 55113043 | | 9/1980 |
| JP | 59159154 | | 9/1984 |
| JP | 1235957 | | 9/1989 |
| JP | 271254 | | 3/1990 |
| JP | 310245 | | 1/1991 |
| JP | 313934 | | 1/1991 |
| JP | 4107445 | | 4/1992 |
| JP | 9288326 | | 11/1997 |
| JP | 10-97020 | * | 4/1998 |
| JP | 10-123651 | * | 5/1998 |

OTHER PUBLICATIONS

Machine translation of JP 10–97020.*
Abstract of JP 10–123651.*
Abstract of JP 59–159154.*
European Search Report EP 00 30 7104.

* cited by examiner

*Primary Examiner*—Janet Baxter
*Assistant Examiner*—Amanda C. Walke
(74) *Attorney, Agent, or Firm*—Bierman, Muserlian and Lucas

(57) ABSTRACT

A red or infrared sensitive silver halide emulsion is disclosed, comprising at least a compound represented by the following formula. A photographic material containing the emulsion is also disclosed.

12 Claims, No Drawings

SILVER HALIDE EMULSION AND SILVER HALIDE LIGHT SENSITIVE PHOTOGRAPHIC MATERIAL

FIELD OF THE INVENTION

The present invention relates to silver halide emulsions, and silver halide light sensitive photographic materials and thermally developable silver halide photographic materials, each of which contains the silver halide emulsion.

BACKGROUND OF THE INVENTION

Silver halide light sensitive photographic materials are prepared employing silver halide grains exhibiting superior characteristics such as high sensitivity, memory and a high S/N ratio. However, the longest inherent sensitivity edge of the silver halide grains is in the vicinity of 500 nm, so that spectral sensitization by the use of sensitizing dyes is indispensable to provide sensitivity at the longer wavelength side. Particularly with recent progress in light sources, importance of photosensitive materials sensitive to the laser wavelength region increases in the field of recording materials for industrial use. On the other hand, reduction of processing effluent is strongly demanded in terms of environmental protection and saving space in the field of the recording materials for industrial use. In this regard, there appeared an image recording system for medical use using semiconductor lasers as a light source and without using liquid system processing chemicals.

Spectral sensitization techniques for silver halide infrared sensitive photographic materials are described in U.S. Pat. Nos. 3,582,344 and 5,013,642; European Patent420,012; Russian Patents 1,549,027, 1,596,961 and 1,780,427; JP-B 3-10391 and 6-52387 (hereinafter, the term, JP-B refers to published Japanese Patent); JP-A (hereinafter, the term, JP-A refers to unexamined and published Japanese Patent Application) 3-138638, 3-138642, 3-235940, 3-242944, 3-244667, 4-311948, 4-312577, 5-72660, 5-45773, 5-45774, 5-45775, 5-72660, 5-72661, 5-265120, 5-341432, 6-194781, 6-222491, 6-222492, 6-250323, 6-301141, 6-317868, 6-332103, 6-324425, 7-175158, 7-306512, 8-194282, 8-201959, 9-281638, 9-281639, 9-288326, 9-288327, 9-292672, and 9-292673; PCT/JP-A 9-5100122. Further, techniques for anti-halation are described in JP-A 7-13295 and U.S. Pat. No. 5,380,635.

Photographic materials to be exposed to infrared rays have advantages that visible absorption caused by sensitizing dyes or anti-halation dyes can be greatly reduced, enabling to form a photographic material substantially having no color. However, a sensitizing dye having an absorption maximum in the infrared region has a long conjugated chain so that the conjugated chain is easily affected by the surrounding to be liable to variation, i.e., the difference between the lowest unoccupied level and the highest occupied level is small and the lowest unoccupied level of a sensitizing dye is close to the conduction band level of silver halide grains, producing problems that fogging is liable to occur, sensitivity is lowered after storage over a period of a long time or variation in sensitivity is easily caused by the temperature or humidity at the time of exposure.

The problems of sensitivity, storage stability and performance variation are marked not only in wet-type photographic materials but also in thermally developable photographic materials (which are also referred to as photothermographic materials). To overcome such problems of infrared sensitization, supersensitization techniques were disclosed, including, for example, supersensitizers for infrared described in European Patent 176,483, 203,698, 465,730 and 509,253; U.S. Pat. Nos. 4,946,962 and 5,024,928; JP-A 61-69063, 62-299838, 63-159840, 2-67546, 2-134630, 2-157744, 4-184332, 4-255841, 5-45833, 5-45834, 5-313289, 6-289555, 8-262612 and 9-211773. Further, examples of the infrared supersensitizers for use in photothermographic materials include aminopolycarboxylic acid derivatives described in JP-A 2-4241, aromatic heterocyclic mercapto compounds and aromatic heterocyclic disulfide compounds. However, it was proved that the aminopolycarboxylic acid derivatives were weak in a supersensitization effect, leading to lower sensitivity and the use of the aromatic heterocyclic mercapto compounds and aromatic heterocyclic disulfide compounds resulted in reduced sensitivity after being stored under high humid conditions. Techniques for enhancing storage stability include, for example, cyclic carbonyl compounds described in JP-A 7-146527 and disulfide compounds having specific structure described in JP-A 10-90823, 10-90824, 10-90825, 10-319534 and 11-4489. However, these techniques were not sufficient in supersensitization and storage stability so that further improvements are desired.

SUMMARY OF THE INVENTION

Accordingly, it is an object of the present invention to provide a red or infrared sensitive silver halide emulsion exhibiting high sensitivity and low fog and little sensitivity variation caused by changing the exposure condition, a silver halide photographic material and silver halide photothermographic material which contain the silver halide emulsion.

The above object of the invention can be accomplished by the following constitution:

1. A silver halide emulsion comprising at least a compound represented by the following formula (1), (2) or (3):

formula (1)

$$Y_1-[S-Ar_1-J_2-T_1-J_1-ArH_1]_{k1}$$

formula (2)

$$W_{11}-S-(T_{11})_{q11}(J_{11})_{q12}-ArH_{11}$$

formula (3)

$$\left[\left\{V_{21}-S-(Ar_{21})_{q21}-J_{22}-T_{21}-J_{21}-ArH_{21}\right\}-J_{23}\right]_{k21}-Q$$

wherein $Y_1$ represents a hydrogen atom, a direct bond or an amidino group; $W_{11}$ represents a hydrogen atom, an aliphatic hydrocarbon group, an aryl group, a heterocyclic group or an amidino group; $V_{21}$ represents a hydrogen atom, an aliphatic hydrocarbon group, an aryl group, a heterocyclic group, RS group or an amidino group, in which R is an alkyl group, aryl group or a heterocyclic group; T and $T_{21}$ each represent a bivalent aliphatic hydrocarbon linkage group or a direct bond; $T_{11}$ represents a bivalent liking group comprised of aliphatic hydrocarbon group; $J_1$, $J_2$, $J_{21}$, $J_{22}$ and $J_{23}$ each represent a bivalent linking group containing at least one of an oxygen atom, sulfur atom and nitrogen atom or a direct bond; $J_{11}$ represents a bivalent linking group containing at least one of an oxygen atom, sulfur atom and nitrogen atom; $Ar_1$ and $Ar_{21}$ each represent an aromatic hydrocarbon group; $ArH_1$, $ArH_{11}$ and $ArH_{21}$ each represent an aromatic hydrocarbon group or an aromatic heterocyclic group; k1 is an integer of 1 or 2; k21 is an integer of 2 to 4; $q_{11}$, $q_{12}$ and $q_{21}$ are each an integer of 0 and 1 and q11+q12≠0; Q represent a k21-valent linking group attached via the $J_{22}$ group to any one of $V_{21}$, $T_{21}$ and $ArH_{21}$.

2. A silver halide emulsion comprising a compound represented by the following formula (4):

formula (4)

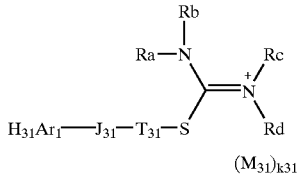

wherein $ArH_{31}$ represents an aromatic hydrocarbon group or an aromatic heterocyclic group; $T_{31}$ represents a bivalent aliphatic hydrocarbon linkage group or a direct bond; $J_{31}$ represents a bivalent linking group containing at least one of an oxygen atom, sulfur atom and nitrogen atom or a direct bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to neutralize an intramolecular charge; and $k_{31}$ represent the number of the ion necessary to neutralize an intramolecular charge;

3. The silver halide emulsion described in 1 or 2, wherein the emulsion further comprises at least a compound represented by the following formula (S-1) or (S-2):

formula (S-1)

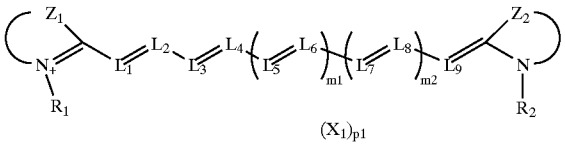

formula (S-2)

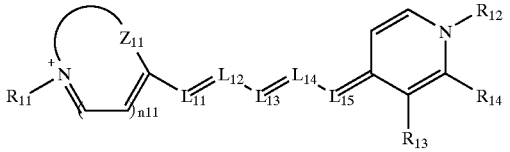

wherein $Z_1$, $Z_2$ and $Z_{11}$ each represent a nonmetallic atom necessary to form a 5- or 6-membered nitrogen containing heterocyclic ring, which may be monocyclic or condensed ring; $L_1$ through $L_9$ and $L_{11}$ through $L_{15}$ each represent a methine group; $R_1$, $R_2$, $R_{11}$ and $R_{12}$ each represent an aliphatic group; $R_{13}$ and $R_{14}$ each represent a hydrogen atom, a substituent group or an atomic group necessary to form a condensed ring between $R_{13}$ and $R_{14}$; $X_1$ and $X_{11}$ each represent an ion necessary to balance with an intramolecular charge; p1 and p11 represent the number necessary to balance with an intramolecular charge; and m1, m2 and n11 are each an integer of 0 or 1;

4. A silver halide light sensitive photographic material comprising a support having thereon a light sensitive silver halide emulsion layer, wherein the silver halide emulsion layer comprises the silver halide emulsion described in 3 above;

5. A thermally developable silver halide photothermographic material comprising on a support an organic silver salt, light sensitive silver halide grains or a component forming a light sensitive silver halide, a reducing agent and a compound represented by the formula (1) through (4) described above;

6. The photothermographic material described in 5, wherein the photothermographic material further comprising a compound represented by the formula (S-1) or (S-2) described above.

DETAILED DESCRIPTION OF THE INVENTION

The silver halide emulsion according to this invention is a red or infrared sensitive silver halide emulsion. The red or infrared sensitive silver halide emulsion refers to a silver halide emulsion having sensitivity to light at the wavelengths of 600 nm of the longest visible wavelength edge or longer, and preferably a silver halide emulsion having a sensitivity maximum at the wavelength of 600 nm or longer. The wavelength of the sensitivity maximum of the silver halide emulsion of this invention is preferably 700 to 900 nm, and more preferably 780 to 850.

The silver halide photographic material according to this invention comprises a compound represented by formula (1), (2), (3) or (4) and a silver halide emulsion sensitive to light in the red to infrared region, and the silver halide emulsion is preferably sensitized with a compound represented by formula (S-1) or (S-2).

The thermally developable photographic material according to this invention (hereinafter, also referred to as photothermographic material) comprises an organic silver salt as a reducible silver source, a reducing agent, and a light sensitive silver halide and/or a light sensitive silver halide forming component, as a photocatalyst. The photothermographic material of this invention comprises a compound represented by formula (1), (2), (3) or (4), and further comprises a compound represented by formula (S-1) or (S-2), whereby supersensitization in the red to infrared region, and preferably in the infrared region can be sufficiently achieved and sensitivity variation caused by changes of humidity can be restrained.

The compounds represented by formulas (1), (2), (3) and (4) will now be detailed. In formulas (1) through (4), the aliphatic hydrocarbon group represented by $W_{11}$ and $V_{21}$ is a straight-chain, branched or cyclic alkyl group (preferably having 1 to 20 carbon atoms, more preferably 1 to 16 carbon atoms, and still more preferably 1 to 12 carbon atoms), alkeny group (preferably having 2 to 20 carbon atoms, more preferably 2 to 16 carbon atoms, and still more preferably 2 to 12 carbon atoms), alkynyl group (preferably having 2 to 20 carbon atoms, more preferably 2 to 16 carbon atoms, and still more preferably 2 to 12 carbon atoms); the aryl group is a monocyclic or condensed aryl group having 6 to 20 carbon atoms (e.g., phenyl, naphthyl, and preferably phenyl); and the heterocyclic group is a 3- to 10-membered, saturated or unsaturated heterocyclic group (e.g., 2-thiazolyl, 1-piperadinyl, 2-pyridyl, 3-pyridyl, 2-furyl, 2-thienyl, 2-benzimidazolyl, carbazolyl, etc.), which may be monocyclic or condensed with other ring to form a condensed ring.

These groups of W11 and $V_{21}$ each may be substituted at any position thereof. Examples of the substituents include an alkyl group (including cycloalkyl and aralkyl groups, and preferably having 1 to 8 carbon atoms, such as methyl, ethyl, n-propyl, isopropyl, n-butyl, tert-butyl, n-heptyl, n-octyl, n-decyl, n-undecyl-hexadecyl, cyclopropyl, cyclopentyl, cyclohexyl, benzyl, and phenethyl), an alkenyl group (preferably having 2 to 20 carbon atoms, more preferably 2 to 12 carbon atoms, and 2 to 8 carbon atoms, e.g., vinyl, allyl, 2-butenyl, 3-pentenyl, etc.), an alkynyl (preferably having 2 to 20 carbon atoms, more preferably 2 to 12 carbon atoms, and 2 to 8 carbon atoms, e.g., propargyl, 3-pentynyl, etc.), aryl group (preferably having 6 to 30 carbon atoms, more preferably 6 to 20 carbon atoms, and 6 to 12 carbon atoms, e.g., phenyl, p-tolyl, o-aminophenyl, naphthyl), an amino group (preferably having 0 to 20 carbon atoms, more preferably 0 10 carbon atoms, and 0 to 6 carbon atoms, e.g., amino, methylamino, ethylamino, dimethylamino, diethylamino, diphenylamino, dibenzylamino, etc.), an imino group (preferably having 1 to 20 carbon atoms, more preferably 1 to 18 carbon atoms, and 1 to 12 carbon atoms, e.g., methylimino, ethylimino, propylimino, phenylimino, etc), an alkoxy group (preferably having 1 to 20 carbon atoms, more preferably 1 to 12 carbon atoms, and 1 to 8 carbon atoms, e.g., methoxy, ethoxy, butoxy, etc.), an aryloxy group (preferably having 6 to 20 carbon atoms, more preferably 6 to 16 carbon atoms, and 6 to 12 carbon atoms, e.g., phenyloxy, 2-naphthyloxy, etc.), an acyl group (preferably having 1 to 20 carbon atoms, more preferably 1 to 16 carbon atoms, and 1 to 12 carbon atoms, e.g., acetyl, formyl, pivaloyl, etc.), an alkoxycarbonyl group (preferably having 2 to 20 carbon atoms, more preferably 2 to 16 carbon atoms, and 2 to 12 carbon atoms, e.g., methoxycarbonyl, ethoxycarbonyl, etc.), an aryloxycarbonyl group (preferably having 7 to 20 carbon atoms, more preferably 7 to 16 carbon atoms, and 7 to 10 carbon atoms, e.g., phenyloxycarbonyl, etc.), an acyloxy group (preferably having 1 to 20 carbon atoms, more preferably 1 to 16 carbon atoms, and 1 to 10 carbon atoms, e.g., acetoxy, benzoyloxy, etc.), an acylamino group (preferably having 1 to 20 carbon atoms, more preferably 1 to 16 carbon atoms, and 1 to 10 carbon atoms, e.g., acetylamino, benzoylamino, etc.), an alkoxycarbonyl group (preferably having 2 to 20 carbon atoms, more preferably 2 to 16 carbon atoms, and 2 to 12 carbon atoms, e.g., methoxycarbonylamino, etc.), an aryloxycarbonyl group (preferably having 7 to 20 carbon atoms, more preferably 7 to 16 carbon atoms, and 7 to 12 carbon atoms, e.g., phenyloxycarbonyl, etc.), a sulfonylamino group (preferably having 1 to 20 carbon atoms, more preferably 1 to 16 carbon atoms, and 1 to 12 carbon atoms, e.g., methanesulfonylamino, benzenesulfonylamino, etc.), a sulfamoylamino group (preferably having 0 to 20 carbon atoms, more preferably 0 to 16 carbon atoms, and 0 to 12 carbon atoms, e.g., sulfamoyl, methylsulfamoyl, dimethylsulfamoyl, phenylsulfamoyl, etc.), a carbamoyl group (preferably having 1 to 20 carbon atoms, more preferably 1 to 16 carbon atoms, and 1 to 12 carbon atoms, e.g., carbamoyl, methylcarbamoyl, diethylcarbamoyl, phenylcarbamoyl, etc.), an alkylthio group (preferably having 1 to 20 carbon atoms, more preferably 1 to 16 carbon atoms and 1 to 12 carbon atoms, e.g., methanesulfonyl, tosylsulfonyl, etc.), an alkylsulfinyl group or arylsulfinyl group (preferably having 1 to 20 carbon atoms, more preferably 1 to 16 carbon atoms, and 1 to 12 carbon atoms, e.g., methanesulfinyl, benzenesulfinyl, etc.), an ureido group (preferably having 1 to 20 carbon atoms, more preferably 1 to 16 carbon atoms, and 1 to 12 carbon atoms, e.g., ureido, methylureido, phenylureido, etc.), a phosphoric acid amido group (preferably having 1 to 20 carbon atoms, more preferably 1 to 16 carbon atoms, and 1 to 12 carbon atoms, e.g., diethylphosphoric acid amido, phenylphosphoric acid amido, etc.), hydroxy group, mercapto group, a halogen atom (e.g., fluorine atom, chlorine atom, bromine atom, iodine atom), cyano group, sulfo group, sulfino group, carboxy group, phosphono group, nitro group, hydroxamic acid group, hydrazine group, and a heterocyclic group (e.g., imidazolyl, benzimidazoyl, thiazolyl, benzthiazolyl, carbazoyl, pyridyl, furyl, piperidyl, morphoryl. etc.).

Of these substituent groups described above, hydroxy group, mercapto group, sulfo group, sulfino group, carboxy group, phosphono group, and phosphino group include their salts. The substituent group may be further substituted. In this case, plural substituent may be the or different.

The preferred substituent group include an alkyl group, aralkyl group, alkoxy group, aryl group, alkylthio group, acyl group, acylamino group, imino group, sulfamoyl group, sulfonyl group, sulfonylamino group, ureido group, amino group, halogen atom, nitro group, heterocyclic group, alkoxycarbonyl group, hydroxy group, sulfo group, carbamoyl group, and carboxy group. Specifically, an alkyl group, alkoxy group, aryl group, alkylthio group, acyl group, acylamino group, imono group, sulfonylamino group, ureido group, amino group, halogen atom nitro group, heterocyclic group, alkoxycarbonyl group, hydroxy group, sulfo group, carbamoyl group and carboxy group are more preferred; and an alkyl group, alkoxy group, aryl group, alkylthio group, acylamino group, imono group, ureido group, amino group, heterocyclic group, alkoxycarbonyl group, hydroxy group, sulfo group, carbamoyl group and carboxy group are still more preferred.

The amidino group represented by $Y_1$, $W_{11}$ and $V_{21}$ may be substituted. Examples of the substituent groups include an alkyl (e.g., methyl, ethyl, pyridylmethyl, benzyl, phenethyl, carboxybenzyl, aminophenyl, etc.), an aryl group (e.g., phenyl, p-tolyl, naphthyl, o-aminophenyl, o-methoxyphenyl, etc.), and a heterocyclic group (e.g., 2-thiazolyl, 2-pyridyl, 3-pyridyl, 2-furyl, 3-furyl, 2-thieno, 2-imidazolyl, benzothiazolyl, carbazolyl, etc.).

The bivalent, aliphatic hydrocarbon linkage group represented by $T_1$, $T_{11}$, $T_{21}$ and $T_{31}$ include a straight-chain, branched cyclic alkylene group (preferably having 1 to 20 carbon atoms, more preferably 1 to 16 carbon atoms, and 1 to 12 carbon atoms), an alkenylene group (preferably having 2 to 20 carbon atoms, more preferably 2 to 16 carbon atoms, and 2 to 12 carbon atoms), an alkynylene group (preferably having 2 to 20 carbon atoms, more preferably 2 to 16 carbon atoms and 2 to 12 carbon atoms), each of which may be substituted by substituent group(s) including those as defined in $V_{21}$, $W_{11}$ and $Y_1$.

Examples of a bivalent linking group containing at least one of an oxygen atom, sulfur atom and nitrogen atom, represented by $J_1$, $J_2$, $J_{21}$, $J_{22}$ and $J_{23}$ include the following groups, which may be combined:

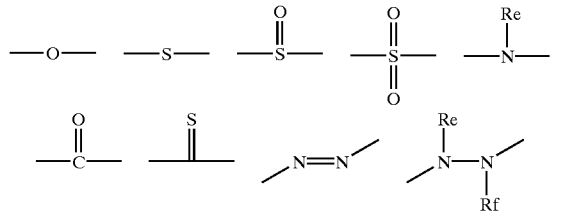

-continued

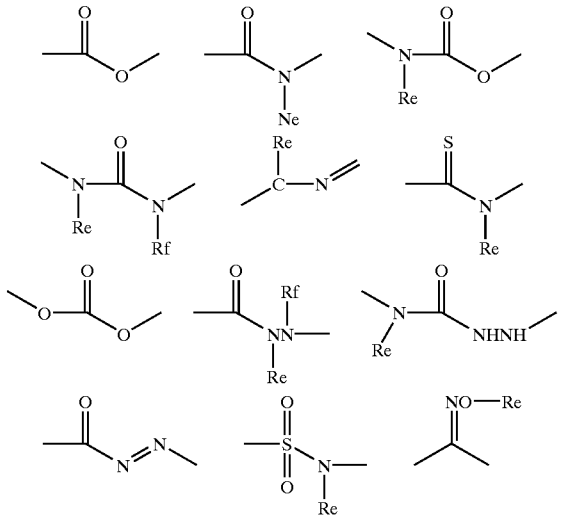

wherein Re and Rf are the same as defined in Ra through Rd.

The aromatic hydrocarbon group represented by $Ar_1$, $Ar_{21}$, $ArH_1$, $ArH_{11}$, $ArH_{21}$ and $ArH_{31}$ are each a monocyclic or condensed aryl group (preferably having 6 to 30 carbon atoms, and more preferably 6 to 20 carbon atoms). Examples thereof include phenyl and naphthyl, and phenyl is preferred.

The aromatic heterocyclic group represented by $ArH_1$, $ArH_{11}$, $ArH_{21}$ and $ArH_{31}$ is a 5- to 10-membered unsaturated heterocyclic group containing at least one of N, O and S, which may be monocyclic or condensed with other ring. A heterocyclic ring of the heterocyclic group is preferably a 5- or 6-membered aromatic heterocyclic ring or its benzo-condensed ring, more preferably a nitrogen-containing, 5- or 6-membered aromatic heterocyclic ring or its benzo-condensed ring, and still more preferably one or two nitrogen-containing, 5- or 6-membered aromatic heterocyclic ring or its benzo-condensed ring. Examples of the aromatic heterocyclic group include groups derived from thiophene, furan, pyrrole, imidazole, pyrazolo, pyridine, pyrazine, pyridazine, triazole, triazine, indole, indazole, purine, thiadiazole, oxadiazole, quinoline, phthalazine, naphthylizine, quinoxaline, quinazolone, cinnoline, pteridine, acrydine, phenathroline, phenazine, tetrazole, thiazole, oxazole, benzimidazole, benzoxazole, benzthiazole, benzothiazoline, benzotriazole, tetrazaindene, and carbazole. Of these, groups derived from imidazole, pyrazolo, pyridine, pyrazine, indole, indazole, thiadiazole, oxadiazole, quinoline, phenazine, tetrazole, thiazole, oxazole, benzimidazole, benzoxazole, benzthiazole, benzothiazoline, benzotriazole, tetrazaindene, and carbazole are preferred; and groups derived from imidazole, pyridine, pyrazine, quinoline, phenazine, tetrazole, thiazole, benzoxazole, benzoimidazole, benzthiazole, benzothiazoline, benzotriazole, and carbazole are more preferred.

The aromatic hydrocarbon group and aromatic heterocyclic group represented by $Ar_1$, $Ar_{21}$, $ArH_1$, $ArH_{11}$, $ArH_{21}$ and $ArH_{31}$ may be substituted. The substituent group is the same as the substituent groups defined in $T_1$, $T_{11}$, $T_{21}$ and $T_{31}$. The substituent group may be further substituted, and plural substituting group may be the same or different. Further, the group represented by $ArH_1$, $ArH_{11}$, $ArH_{21}$, and $ArH_{31}$ is preferably an aromatic heterocyclic group.

The aliphatic hydrocarbon group, ary group and heterocyclic group represented by Ra, Rb, Rc, Rd, Re and Rf are the same as those defined in $W_{11}$ and $V_{21}$. The preferred range thereof is the same as defined in $W_{11}$ and $V_{21}$.

The acyl group represented by Ra, Rb, Rc, Rd, Re and Rf includes an aliphatic or aromatic one, such as acetyl, benzoyl, formyl, and pivaloyl. The nitrogen containing heterocyclic group formed by combination of Ra and Rb, Rc and Rd, Ra and Rc, or Rb and Rd includes a 3- to 10-membered unsaturated heterocyclic ring (e.g., ring groups such as piperidine ring, piperazine ring, acridine ring, pyrrolidine ring, pyrrol ring and morphorine ring).

Examples of acid anions used as the ion necessary to neutralize an intramolecular charge, represented by $M_{31}$ include a halide ion (e.g., hloride ion, bromide ion, iodide ion, etc.), p-toluenesulfonate ion, perchlorate ion, tetrafluorobarate ion, sulfate ion, methylsulfate ion, ethylsulfate ion, methansufonic acid ion and trifluoromethanesulfonic acid ion.

The k21-valent linking group represented by Q can be selected from an element, aliphatic group, aromatic group, heterocyclic group, and a linking bond, each of which has a valence number of 2 to 4. Examples of the element include a nitrogen atom, phosphorus atom, oxygen atom, sulfur atom, carbon atom and boron atom. Examples of the aliphatic group include an 1 to 4 bonds-containing alkylene group (e.g., methylene, 1,2-ethylene, propane-1,2,3-tri-yl) and an 1 to 4 bonds-containing alkenylene group (e.g., propene-1,3-di-yl). Examples of the aromatic group include monocyclic or condensed rings containing 1 to 4 bonds and comprised of 5 to 14 carbon atoms (e.g., benzene-1,2-di-yl, benzene-1,3,5-tri-yl, naphthalene-1,8-diyl); and example of the heterocyclic group include 1 to 4 bonds-containing, monocyclic or condensed heterocycles (e.g., pirydine-2,6-di-yl, triazine-1,3,5-tri-yl, triazine-2,4,6-triyl, piperidine-1,4-diyl).

In the compounds represented by formula (2), $W_{11}$ is preferably a hydrogen atom or amidino group; and in the compounds represented by formula (3), $V_{21}$ is preferably a hydrogen atom, Rs group or amidino group.

Exemplary examples of the compounds represented by formulas (1) through (4) are shown below, but the present invention is not limited to these.

1

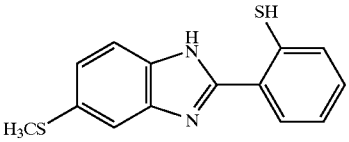

2

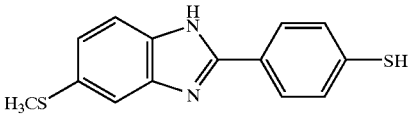

-continued
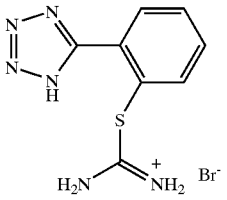
3
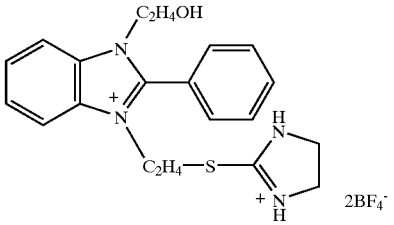
4
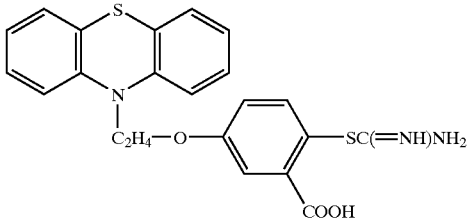
5
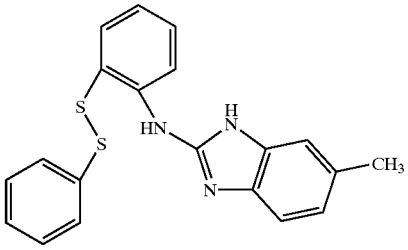
6
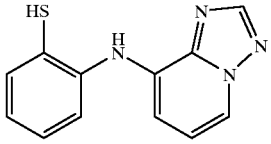
7
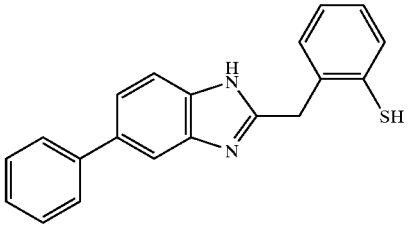
8
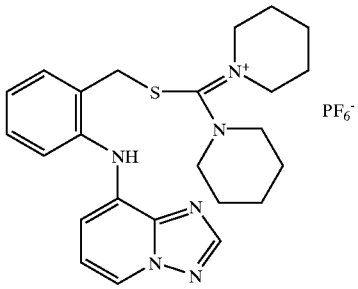
9
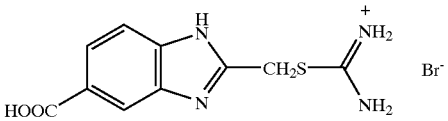
10
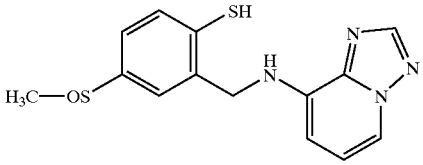
11
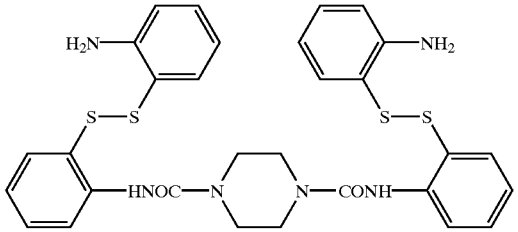
12
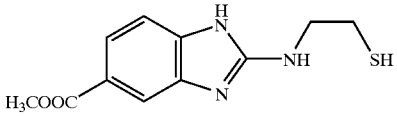
13
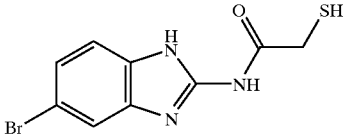
14

-continued
15
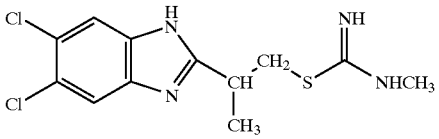
16
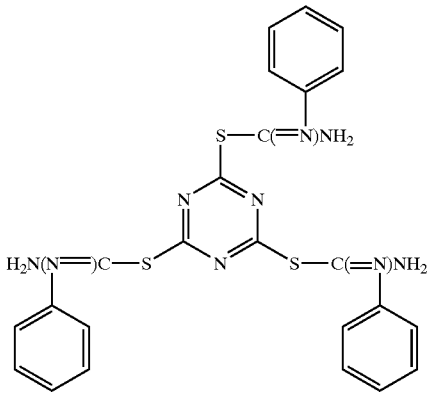
17
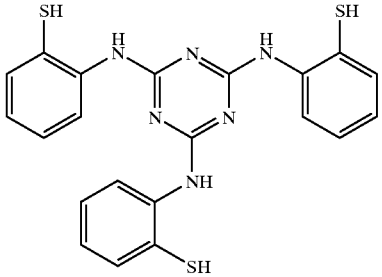
18
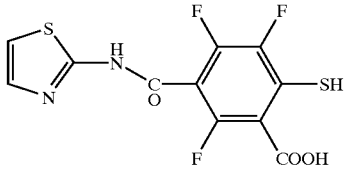
19
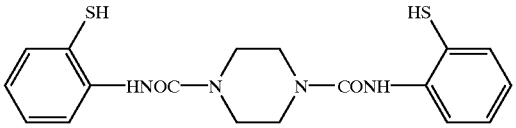
20
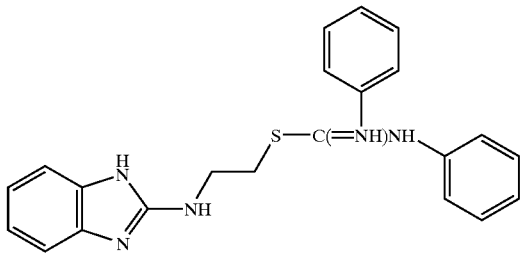
21
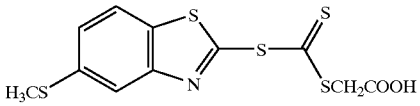
22
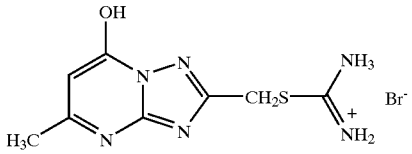
23
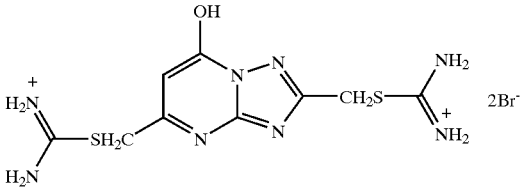
24
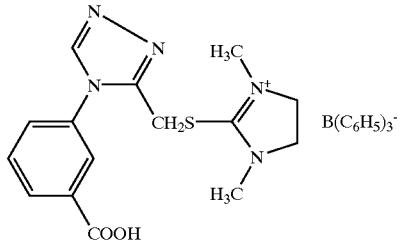
25
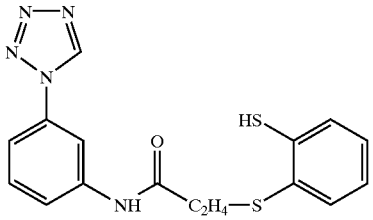

-continued
26
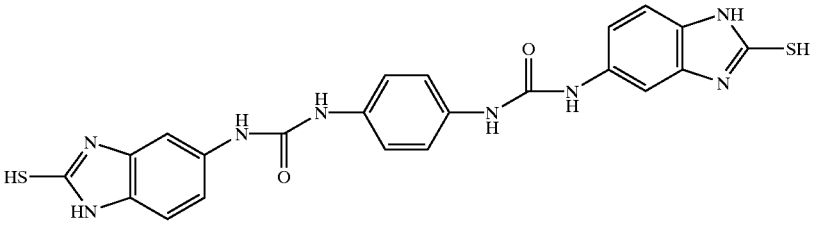
27
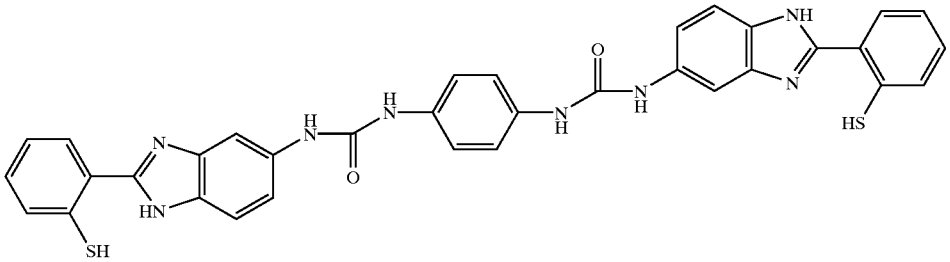
28
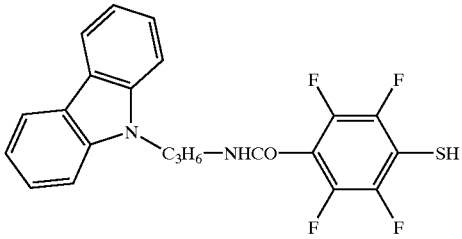
29
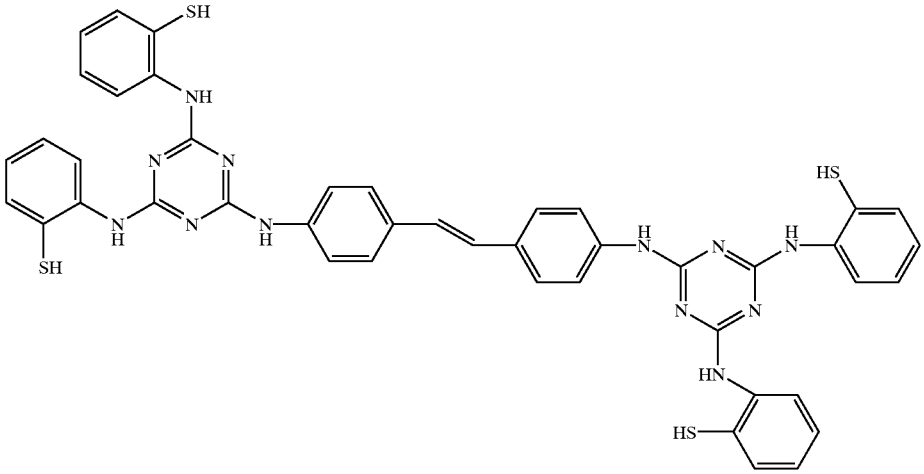
30
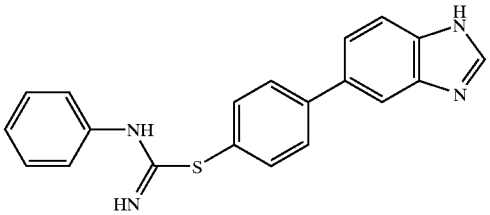
31
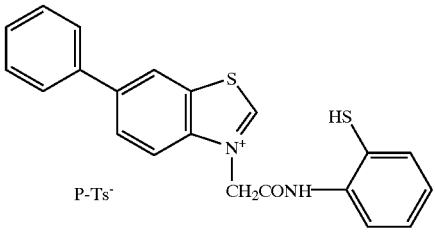

-continued
32
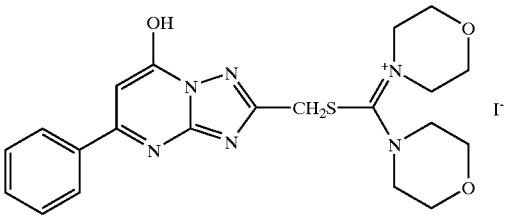
33
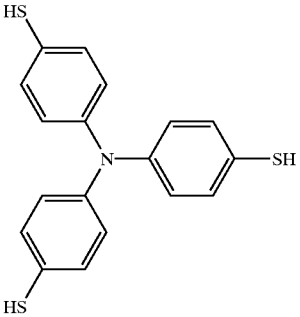
34
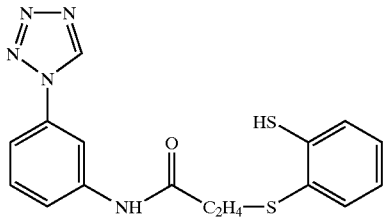
35
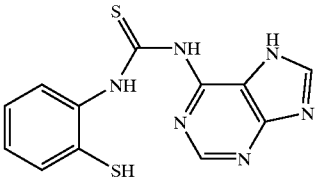
36
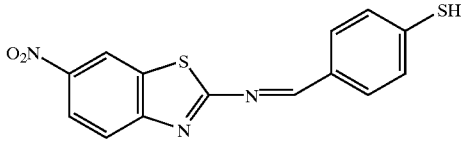
37
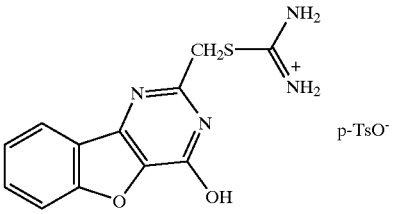
38
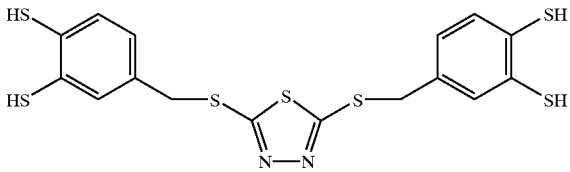
39
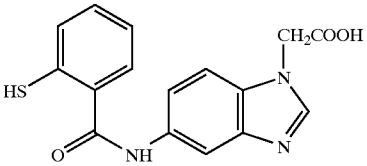
40
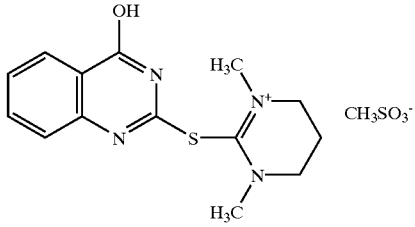
41
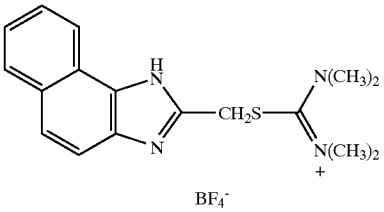
42
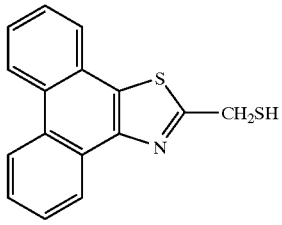
43
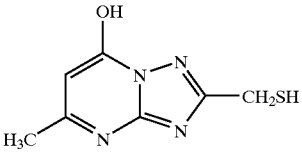
44
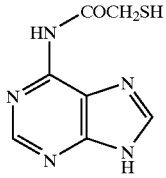

-continued

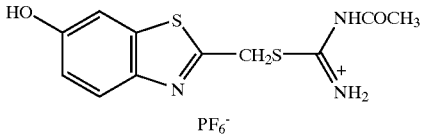

The compounds represented by formulas (1) through (4) are commercially available and can also be readily synthesized according to the methods known in the art, for example, the methods described in "Shin-Jikken Kagaku Koza" (New Series of Experimental Chemistry) vol. 14 (III), page 1739–1741 (edited by Chemical Society of Japan, 1978).

In photothermographic materials according to this invention, the compound represented by formulas (1) though (4) may be incorporated into a light sensitive layer or a light-insensitive layer, and preferably a light sensitive layer as an image forming layer. The addition amount of the compound represented by formulas (1) though (4), depending of the intended purpose, is preferably 10-4 to 1 mol/mol Ag, more preferably 10-3 to 0.3 mol/mol Ag, and still more preferably 10-3 to 0.1 mol/mol Ag.

The compound of formulas (1) through (3) or of formula (4) each can be used alone or in combination. The compound of formulas (1) through (4) may be incorporated by dissolving in water or appropriate organic solvents such as alcohols (e/g/, methanol, ethanol, propanol, fluoroalcohol), ketones (e.g., acetone, methyl ethyl ketone), dimethylformamide, dimethylsulfoxide, and methyl cellosolve. Alternatively, the compound can be incorporated by the well known emulsion-dispersing method, in which the compound is dissolved in oils such as dibutyl phthalate, tricresyl phosphate and glyceryl triacetate and diethyl phthalate and auxiliary solvents such as ethyl acetate and cyclohexanone and then an emulsified dispersion is mechanically prepared. Further, the method known as a solid dispersion method is also employed, in which solid powdery particles are dispersed in water by means of a ball mill, colloid mill, sand grinder mill, Manton-Gaulin homogenizer, microfluidizer or ultrasonic homogenizer. Surfactants may be used in dispersing fine solid particles.

The compound represented by formula (S-1) or (S-2) will be detailed. In the formula (S-1) or (S-2), $Z_1$, $Z_2$ and $Z_{11}$ are each a nonmetallic atom group necessary to complete a 5- or 6-membered monocyclic or condensed nitrogen-containing heterocyclic ring. Examples thereof include an oxazole nucleus (e.g., oxazolidine ring, oxazoline ring, benzoxazole ring, tetrahydrobenzoxazole ring, naphthoxazole ring, benzonaphthoxazole ring), imidazole nucleus (e.g., imidazolidine ring, imidazoline ring, benzimidazole ring, tetrahydrobenzimidazole ring, naphthoimidazole ring, benzonaphthoimidazole ring), thiazole nucleus (e.g., thiazolidine ring, thiazoline ring, benzothiazoline ring, tetrahydrobenzothiazole ring, naphthothiazole ring, benzonaphthothiazole ring), selenazole nucleus (e.g., selenazolidine ring, selenazoline ring, benzoselenazole ring, tetrahydrobenzoselenazole ring, naphthoselenazole ring, benzonaphthoselenazole ring), tellurazole nucleus (e.g., tellurazolidine ring, tellurazoline ring, benzotellurazole ring), pyridine nucleus (e.g., pyridine ring, quinoline), and pyrrole nucleus (e.g., pyrrolidine ring, pyrroline ring, pyrrole ring, 3,3-dialkylindolenine, 3,3-dialkylbenzoindolenine ring). These nuclei each may be substituted. Examples of groups capable of being substituted on these nuclei include a lower alkyl group (e.g., methyl, ethyl, propyl, isopropyl, t-pentyl, methylthioethyl, methoxyethyl), a vinyl group, a styryl group, an aryl group (e.g., phenyl, p-tolyl, p-bromophenyl), a trifluoromethyl group, an alkoxy group, (e.g., methoxy, ethoxy, isopropoxy), an aryloxy group (e.g., phenoxy, p-tolyloxy), alkylthio group (e.g., methylthio, ethylthio, benzylthio), an arylthio group (e.g., phenylthio, p-bromophenylthio, p-methoxyphenylthio), a carbonyloxy group (e.g., acetyloxy, propanoyloxy, benzoyloxy), an amino group (e.g., amino, dimethylamino, anilino), a heterocyclic group (e.g., pyridyl, pyrrolyl, furyl, thienyl, imidazolyl, thiazolyl, pyrimidinyl), an acyl group (e.g., acetyl, benzoyl), a cyano group, a carbamoyl group (e.g., N,N-dimethylcarbamoyl, morpholinocarbonyl), a sulfamoyl group (e.g., sulfamoyl, N-phenylsulfamoyl, morpholinosulfonyl), an acylamino group (e.g., acetylamino, benzoylamino, o-hydroxybenzoylamino), a sulfonylamino group (e.g., methanesulfonyamino, benzenesulfonylamino), an alkoxycarbonyl group (e.g., methoxycarbonyl, ethoxycarbonyl, trifluoroethoxycarbonyl), a hydroxy group, a carboxy group, a sulfonyl group (e.g., methanesulfonyl, ethanesulfonyl, benzenesulfonyl), a sulfinyl group (e.g., methylsulfinyl, ethylsulfinyl, trifluorosulfinyl, phenylsulfinyl). These substituting groups may be substituted on any position.

Examples of the aliphatic group represented by $R_1$, $R_2$, $R_{11}$ and $R_{12}$ include a straight-chain or branched alkyl group having 1 to 10 carbon atoms (e.g., methyl, ethyl, propyl, butyl, pentyl, iso-pentyl, 2-ethyl-hexyl, octyl, decyl), an alkenyl group having 3 to 10 carbon atoms (e.g., 2-prpopenyl, 3-butenyl, 1-methyl-3-propenyl, 3-pentenyl, 1-methyl-3-butenyl, 4-hexenyl), and an aralkyl group having 7 to 10 carbon atoms (benzyl, phenethyl), each of which may be further substituted. Examples of the substituting group include a lower alkyl group (e.g., methyl, ethyl, propyl), a halogen atom (e.g., fluorine atom, chlorine atom bromine atom), a vinyl group, an aryl group (e.g., phenyl, p-tolyl, p-bromophenyl), trifluoromethyl, an alkoxy group (e.g., methoxy, ethoxy, methoxyethyl), an aryloxy group (e.g., phenoxy, p-tolyloxy), cyano, a sulfonyl group (e.g., methanesulfonyl, trifluoromethanesulfonyl, p-toluenesulfonyl), an alkoxycarbonyl group (e.g., ethoxycarbonyl, butoxycarbonyl), an amino group (e.g., amino, biscarboxy-methylamino), an aryl group (e.g., phenyl, carboxyphenyl), a heterocyclic group (e.g., tetrahydrofurfuryl, 2-pyrrolidinone-1-yl), an acyl group (e.g., acetyl, benzoyl), a ureido group (e.g., ureido, 3-methylureido, 3-phenylureido), a thioureido group (e.g., thioureido, 3-methylthioureido), an alkylthio group (e.g., methylthio, ethylthio), an arylthio group (e.g., phenylthio), a heterocyclic-thio group (e.g., 2-thienylthio, 3-thienylthio), a carbonyloxy group (e.g., acetyloxy, propanoyloxy, benzoyloxy), an acylamino group (e.g., acetylamino, benzoylamino), a thioamido group (e.g., thioacetoamido, thiobenzoylamino), and hydrophilic groups such as a sulfo group, carboxy group, phosphono group, sulfato group, hydroxy group, mercapto group, sulfino group, carbamoyl group (e.g., carbamoyl, N-methylcarbamoyl, N,N-tetramethylenecarbamoyl), sulfamoyl group (e.g., sulfamoyl, N,N-3-oxapentamethyleneaminosulfonyl), sulfonamido group (e.g., methanesulfonamido, butanesulfoneamido), sulfonylaminocarbonyl group (e.g., methanesulfonylaminocarbonyl, ethanesulfonylaminocarbonyl), acylaminosulfonyl group (e.g., acetoamidosulfonyl, methoxyacetoamidosulfonyl), acylaminocarbonyl group (e.g., acetoamidocarbonyl, methoxyacetoamidocarbonyl), sulfinylaminocarbonyl group (e.g., methanesulfinylaminocarbonyl, ethanesulfinylaminocarbonyl) and sulfoamino group.

Aliphatic groups substituted by such a hydrophilic group include, for example, carboxymethyl, carboxybutyl, carboxypentyl, 3-sulfatobutyl, 3-sulfopropyl, 2-hydroxy-3-sulfopropyl, 4-sulfobutyl, 5-sulfopentyl, 3-sulfobentyl, 3-sulfinobutyl, 3-phosphonopropyl, hydroxyethyl, N-methanesulfonylcarbamoylmethyl, N-acetylaminosulfonylmethyl, sulfoaminopropyl, 2-carboxy-2-propenyl, o-sulfobenzyl, p-sulfophenethyl, and p-carboxybenzyl.

Examples of the substituent group represented by $R_{13}$ or $R_{14}$ include an alkyl group (e.g., methyl, ethyl, butyl, isobutyl), an aryl group (including a monocyclic and polycyclic ones, e.g., phenyl, naphthyl), a heterocyclic group (e.g., thienyl, furyl, pyridyl, carbazolyl, pyrrolyl, indolyl), a halogen atom (e.g., fluorine atom, chlorine atom, bromine atom), a vinyl group, trifluoromethyl group, an alkoxy group (e.g., methoxy, ethoxy, methoxyethoxy), an aryloxy group (e.g., phenoxy, p-tolyloxy), an alkylsulfonyl group or arylsulfonyl group (e.g., methanesulfonyl, p-toluenesulfonyl), a sulfinyl group (e.g., methylsulfinyl, phenylsulfinyl), an alkoxycarbonyl group (e.g., ethoxycarbonyl, butoxycarbonyl), an amino group (e.g., amino, methylamino, biscarboxy-methylamino, acetylamino, benzoylamino), a heterocyclic group. (e.g., tetrahydrofurfuryl, 2-pyloridinone-1-yl), an acyl group (e.g., acetyl, benzoyl), a ureido group (e.g., ureido, 3-methylureido, 3-phenylureido), a thioureido group (e.g., thioureido, 3-methylthioureido), an alkylthio group (e.g., methylthio, ethylthio) and an arylthio group (e.g., phenylthio). These groups each may be substituted by substituent groups as cited in the aliphatic group represented by such $R_1$, and the substituted alkyl group include, for example, 2-methoxyethyl, 2-hydroxyethyl, 3-ethoxycarbonylpropyl, 2-carbamoylethyl, 2-methanesulfonylethyl, 3-methanesulfonylaminopropyl, benzyl, phenethyl, carboxymethyl, carboxymethyl, allyl, and 2-furylethyl. Substituted aryl groups include, for example, p-carboxyphenyl, p-N,N-dimethylaminophenyl, p-morpholinophenyl, p-methoxyphenyl, 3,4-dimethoxyphenyl, 3,4-methylenedioxyphenyl, 3-chlorophenyl, and p-nitrophenyl. Substituted heterocyclic groups include, for example, 5-chloro-2-pyridyl, 5-ethoxycarbonyl-2-pyridyl and 5-carbamoyl-2-pyridyl. The condensed ring which $R_{13}$ and $R_{14}$ link to gether with each other to form include, for example, 5- or 6-membered saturated or unsaturated rings. Substitution is capable on any position of the ring and the substituent group is the same as defined in $R_{13}$ and $R_{14}$.

In formulas (S-1) and (S-2), the methine group represented by $L_1$ through $L_9$ and $L_{11}$ through $L_{15}$ is a substituted or unsubstituted methine group. The substituent group include, for example, a substituted or unsubstituted, lower alky group (e.g., methyl, ethyl, iso-propyl, benzyl), alkoxy group (e.g., methoxy, ethoxy), aryloxy group (e.g., phenoxy, naphthoxy), aryl group (e.g., phenyl, naphthyl, p-tolyl, o-carboxyphenyl), —N($V_1$)($V_2$)— group, —SR group or a heterocyclic group (e.g., 2-thienyl, 2-furyl, N,N-bis (methoxyethyl)barbituric acid, in which $R_1$ is a lower alky group, aryl group or heterocyclic group, and $V_1$ and $V_2$ are each substituted or unsubstituted lower alkyl or aryl group, or $V_1$ and $V_2$ link together with each other to form a 5- or 6-membered, nitrogen-containing ring. The methine can link together with an adjacent one or one next thereto to form a 5- or 6-membered ring.

In cases where the compound represented by formula (S-1) or (S-2) is substituted by a cationic or anionic group, an equivalent amount of anionic or cationic counter ion is formed to neutralize an intramolecular charge. Of the ion necessary to neutralize an intramolecular charge represented by $X_1$ or $X_{11}$, examples of the cation include proton, organic ammonium ion (e.g., triethylammonium, triethanolammonium, pyridinium, etc.) and inorganic ions (e.g., lithium, sodium, potassium, calcium, and magnesium ions, etc.). Examples of acid anions include halide ions (chloride ion, bromide ion, iodide ion), p-toluenesulfonic acid ion, perchlorate ion, tetrafluoroborate ion, sulfate ion, methylsulfate ion, ethylsulfate ion, methanesulfonic acid ion, and trifluoromethanesulfonic acid ion.

Exemplary examples of the sensitizing dyes represented by formulas (S-1) and (S-2) are shown below, but are not limited to these.

No.1

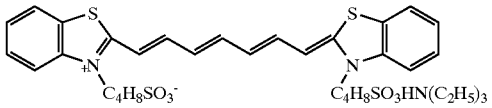

No.2

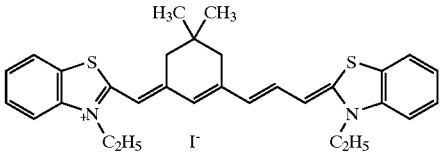

No.3

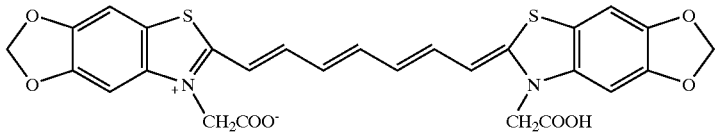

-continued
No.4
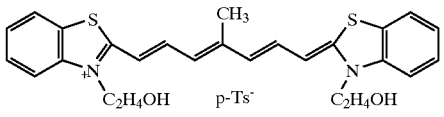
No.5
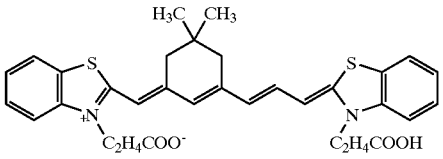
No.6
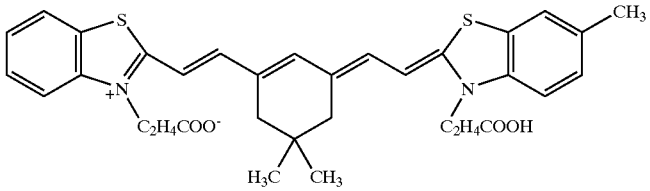
No.7
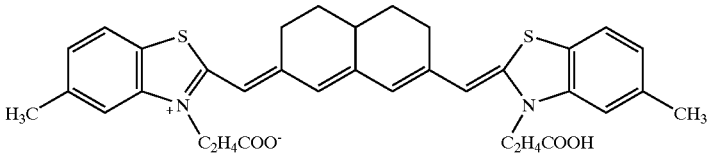
No.8
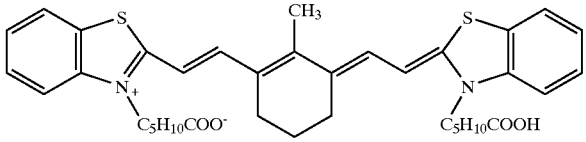
No.9
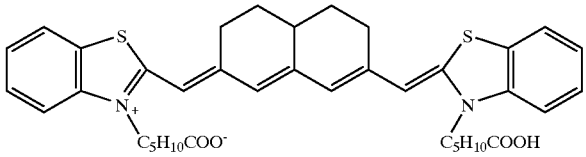
No.10
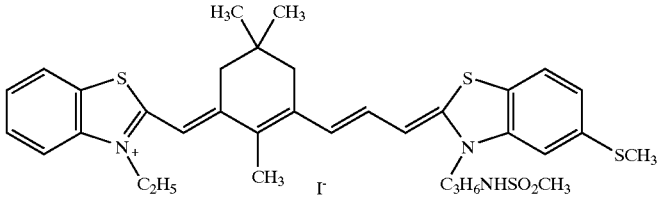
No.11
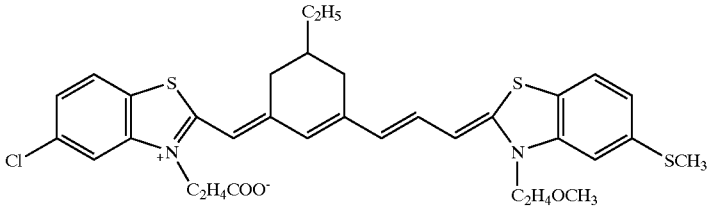
No.12
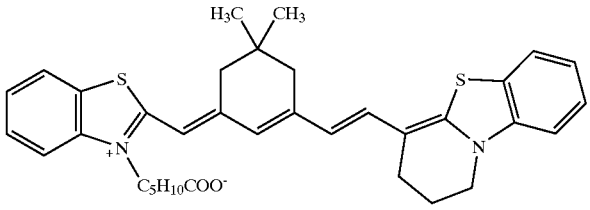

-continued
No.13
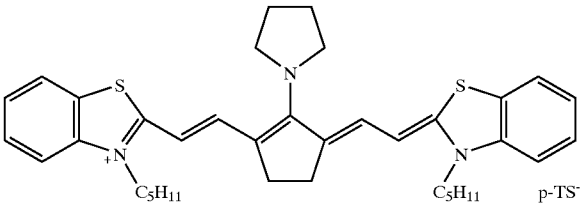
No.14
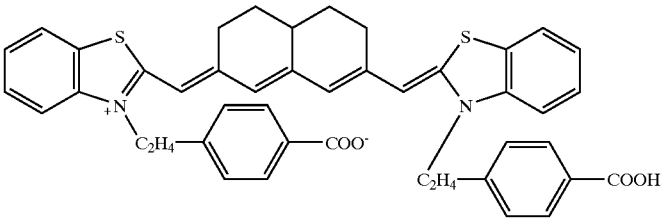
No.15
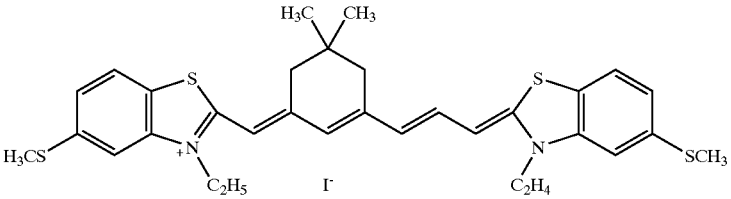
No.16
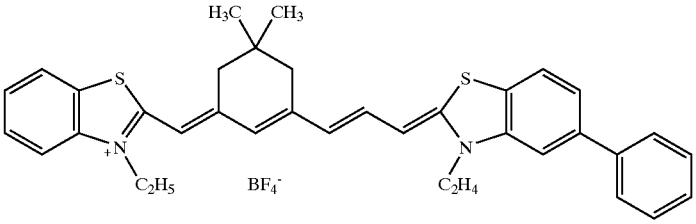
No.17
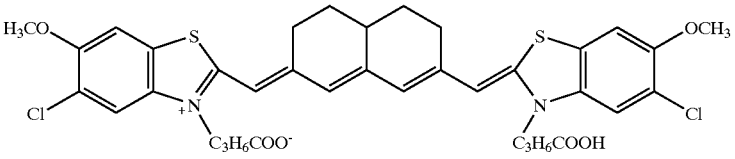
No.18
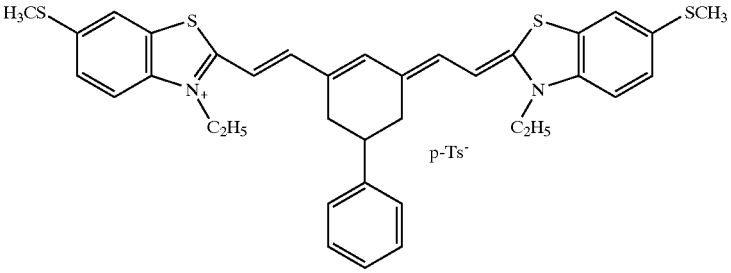
No.19
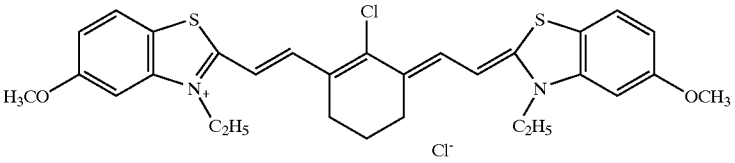

-continued
No.20
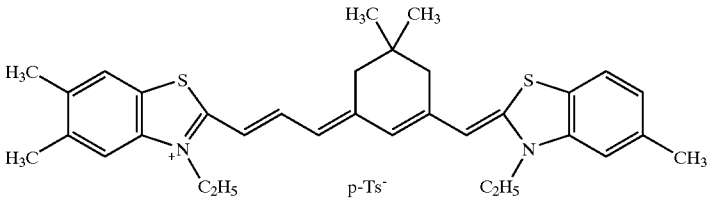
No.21
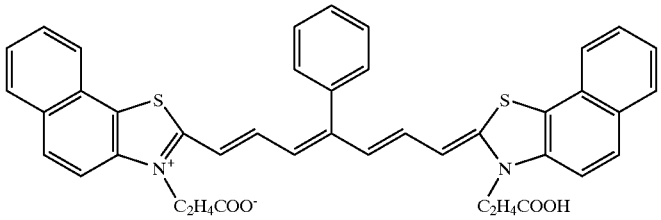
No.22
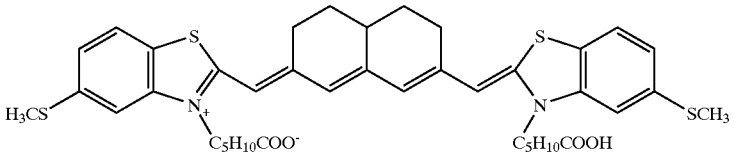
No.23
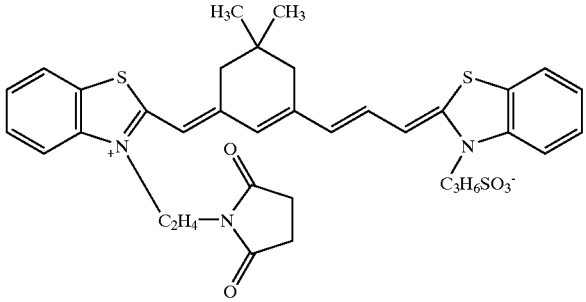
No.24
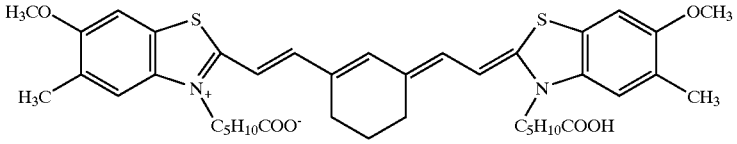
No.25
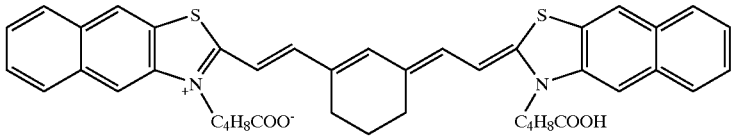
No.26
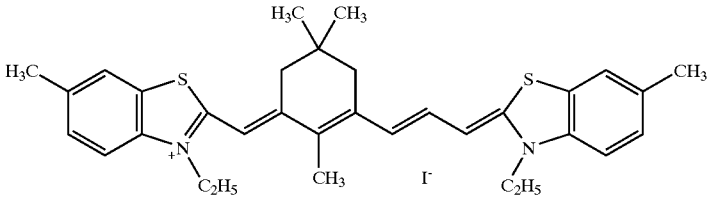
No.27
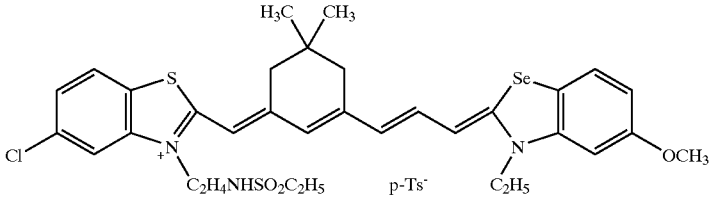

-continued
No.28
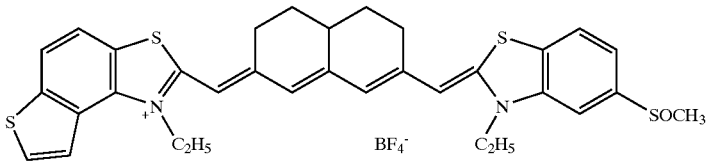
No.29
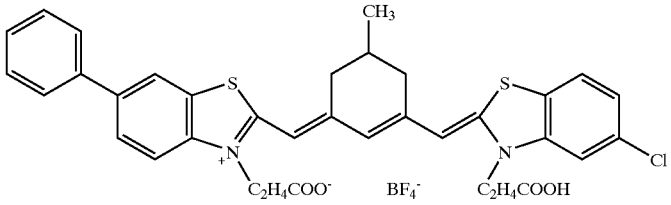
No.30
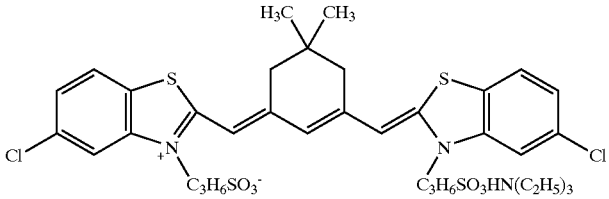
No.31
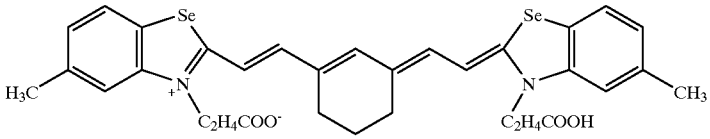
No.32
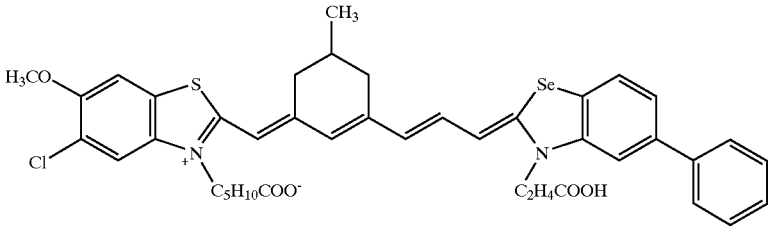
No.33
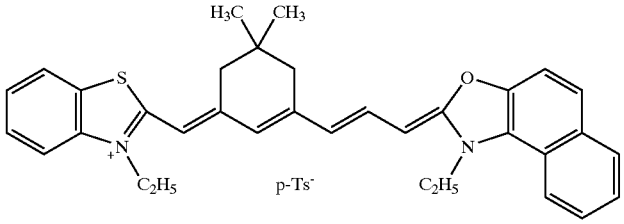
No.34
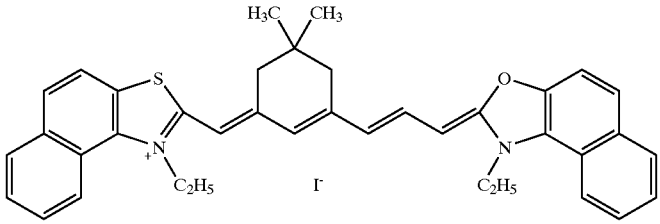

-continued
No.35
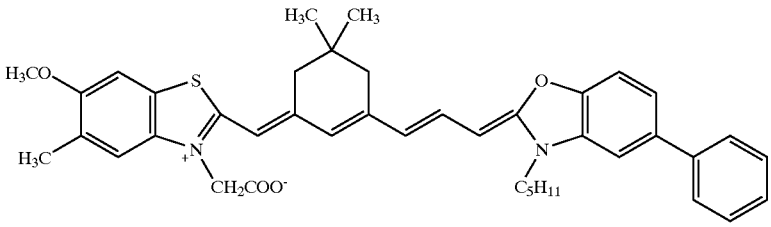
No.36
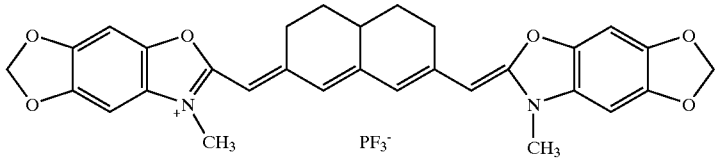
No.37
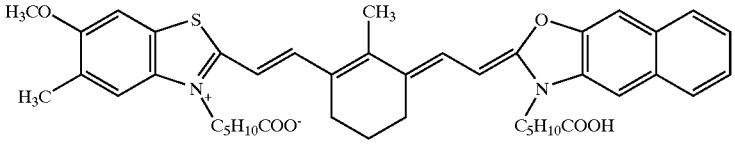
No.38
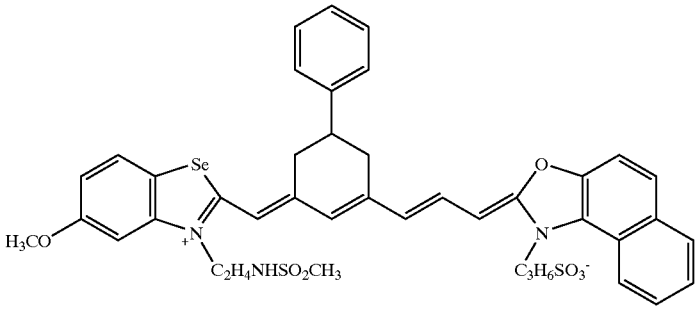
No.39
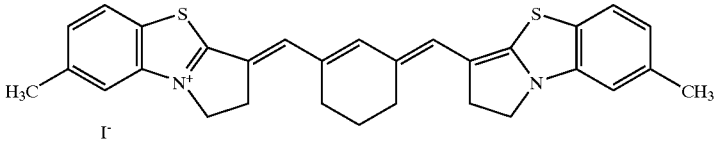
No.40
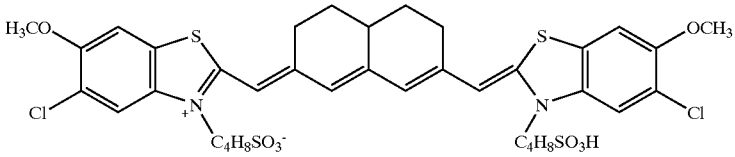
No.41
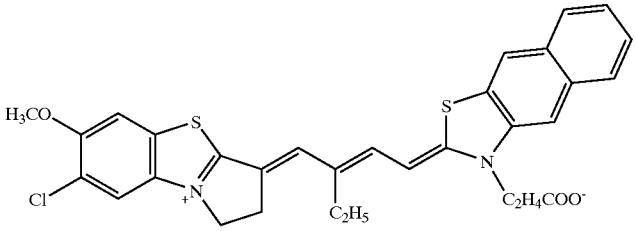

-continued
No.42
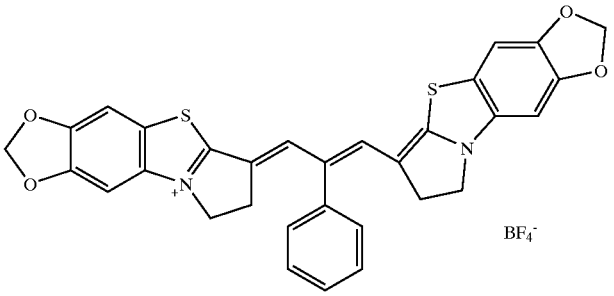
No.43
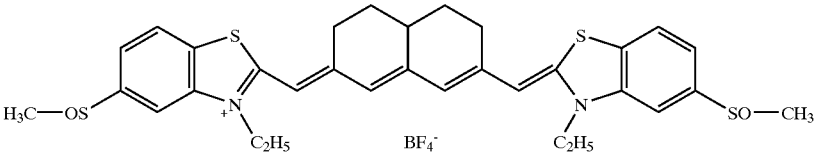
No.44
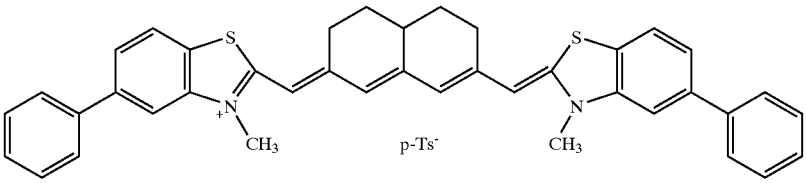
No.45
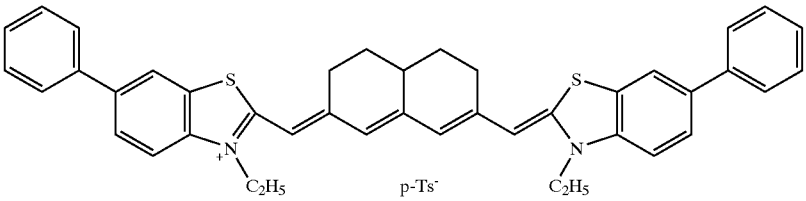
No.46
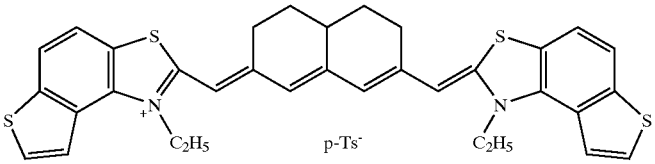
No.47
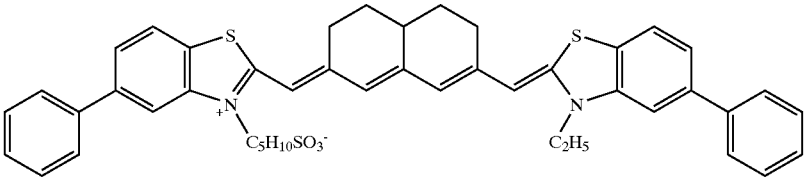
No.48
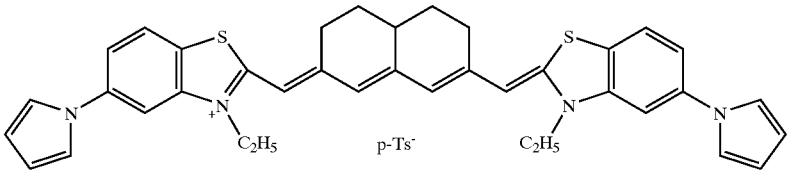
No.49
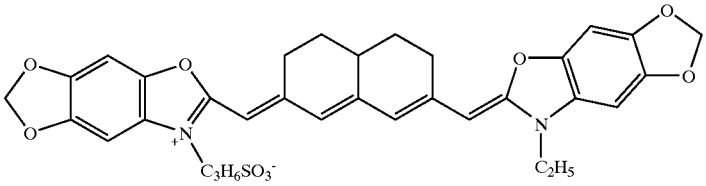

-continued
No.50
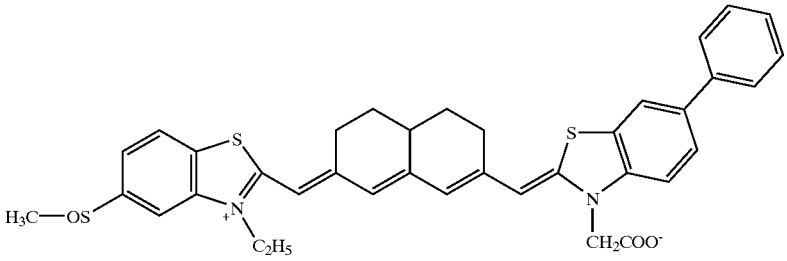
No.51
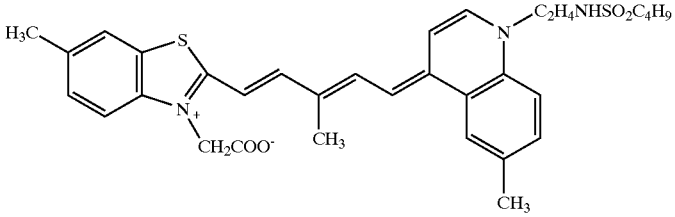
No.52
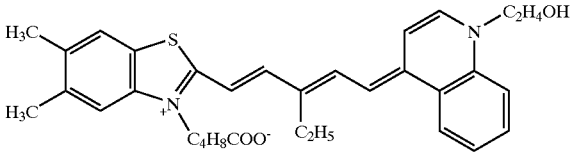
No.53
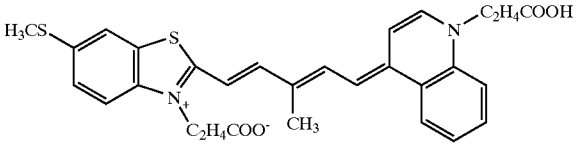
No.54
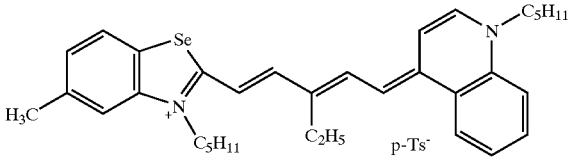
No.55
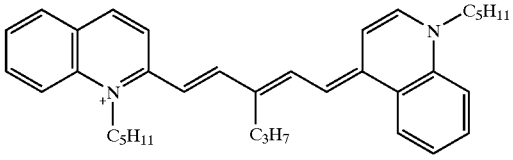
No.56
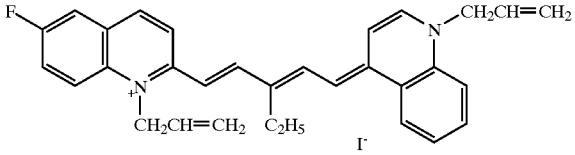
No.57
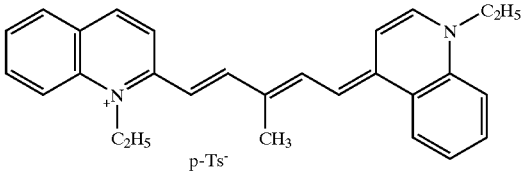
No.58
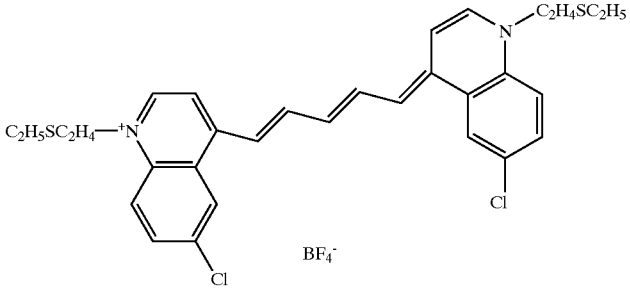
No.59
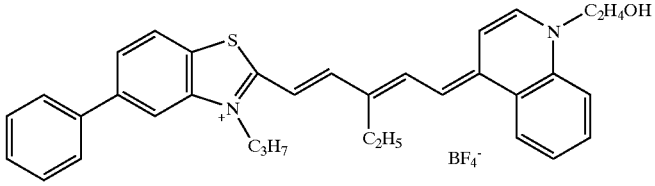

-continued
No.60
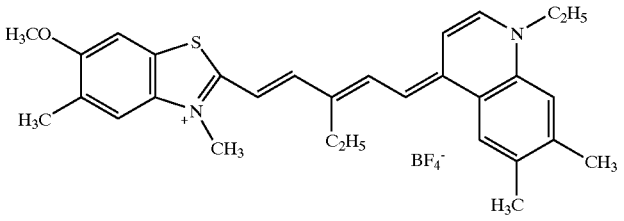
No.61
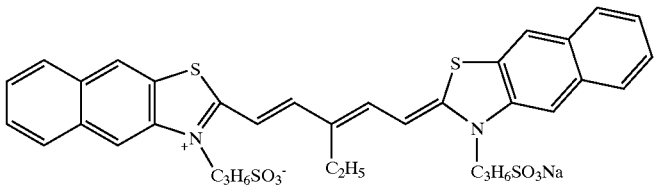
No.62
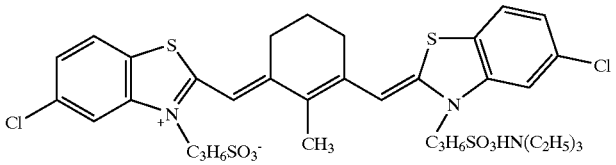
No.63
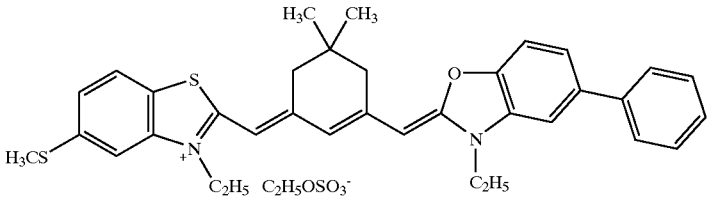
No.64
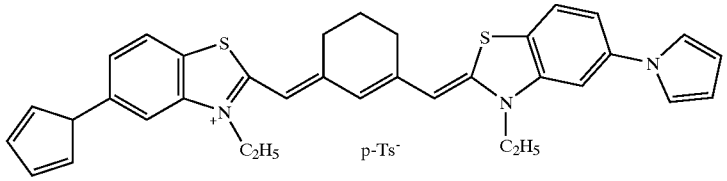
No.65
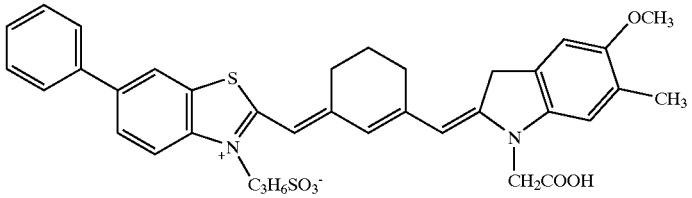
No.66
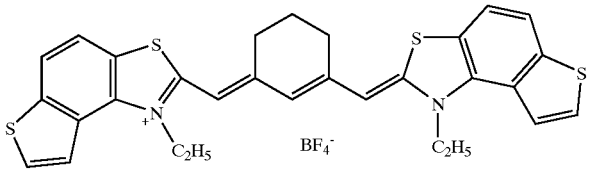
No.67
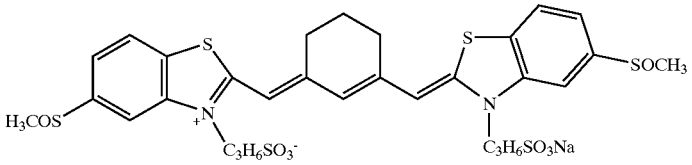

-continued
No.68
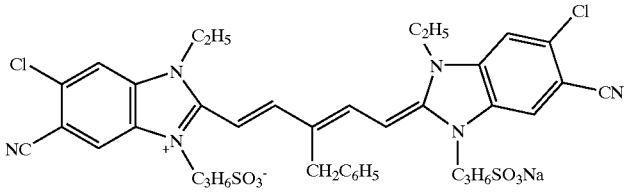
No.69
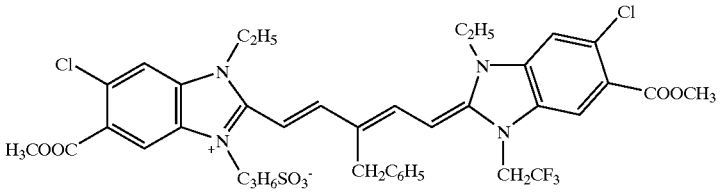
No.70
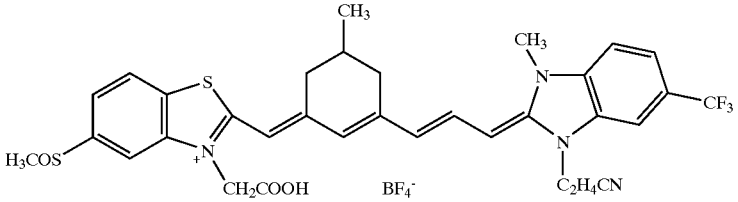
No.71
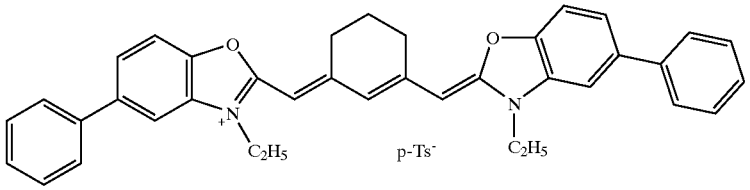
No.72
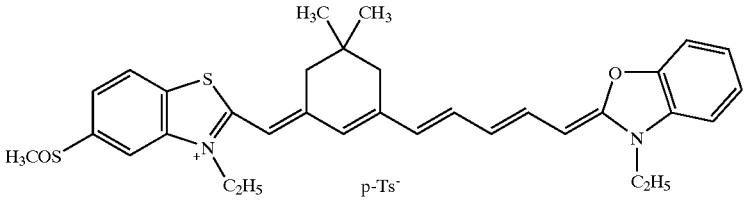
No.73
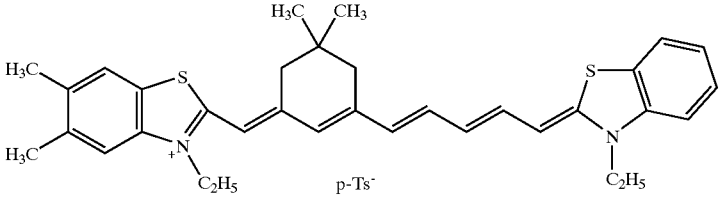
No.74
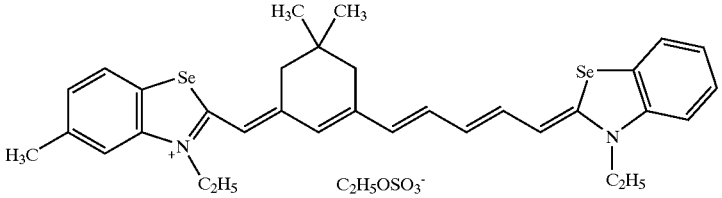
No.75
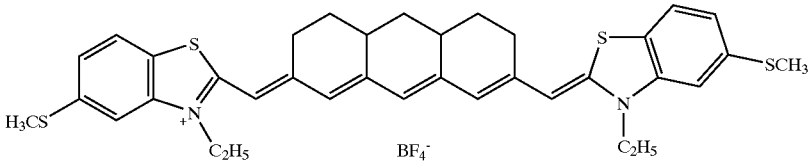

-continued

No.76

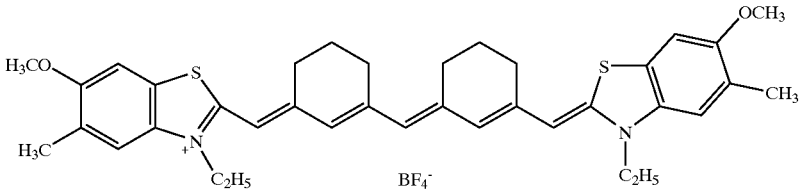

No.77

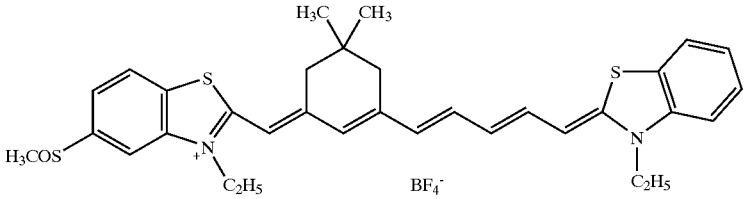

No.78

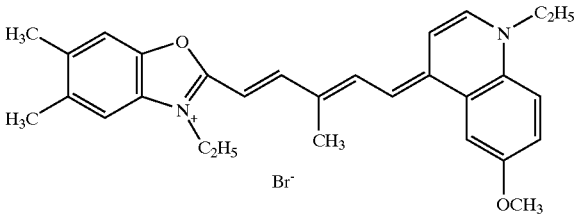

No.79

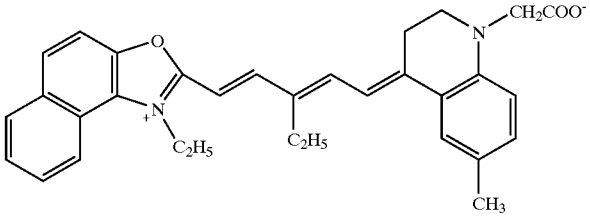

No.80

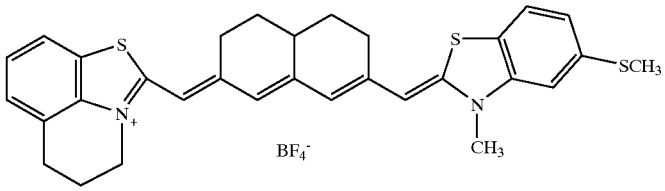

The infrared sensitizing dyes described erlier can be readily synthesized according to the methods described in F. M. Hammer, The Chemistry of Heterocyclic Compounds vol.18, "The cyanine Dyes and Related Compounds" (A. Weissberger ed. Interscience Corp., New York, 1964); JP-A 3-138638 and 10-73900; Japanese Patent Application Publication No. 9-510022; U.S. Pat. No. 2,734,900 and British patent 774,779.

The sensitizing dye used in this invention may be used alone or in combination. In either case when used alone or used in combination, the total amount of the dye(s) to be incorporated is preferably $1\times10^{-6}$ to $5\times10^{-3}$, more preferably $1\times10^{-5}$ to $2.5\times10^{-3}$, and still more preferably $4\times10^{-5}$ to $1\times10^{-3}$ mol per mol of silver halide.

In cases when dyes are used in combination, the dyes can be incorporated in any proportion. The dye may be directly dispersed in a silver halide emulsion. Alternatively, the may be dissolved in an appropriate solvent such as methanol, ethanol, n-propanol, methyl cellosolve, acetone, water, pyridine, or a mixture thereof and added to the emulsion in the form of a solution. Ultrasonic can also be employed. The sensitizing dye can be added in such a manner that a dye is dissolved in a volatile organic solvent, the resulting solution is dispersed in a hydrophilic colloidal medium and the dispersion is added to the emulsion, as described in U.S. Pat. No. 3,469,987; a water-insoluble dye is dispersed in aqueous medium without being dissolved and the dispersion is added to the emulsion, as described in JP-B 46-24185 (hereinafter, the term, JP-B means a published Japanese Patent); a dye is dissolved using a surfactant and the resulting solution is added to the emulsion, as described in U.S. Pat. No. 3,822,135; a dye is dissolved using a compound capable of shifting to longer wavelengths and the solution is added to the emulsion, as described in JP-A 51-74624; or a dye is dissolved in an acid substantially containing no water and the solution is added to the emulsion, as described in JP-A 50-80826. Further, the dye may be added according to the method described in U.S. Pat. Nos. 2,912,343, 3,342,605, 2,996,287 and 3,492,835. The dye may be homogeneously dispersed in a silver halide emulsion before coating on a support, or may be dispersed at any stage of preparing the silver halide emulsion.

In cases when used in combination, the dyes can be independently or in the form of a mixture dispersed in a silver halide emulsion. In addition to the compound represented by formulas (1) to (3) used in combination with the sensitizing dye represented by formula (S-!9 or (S-2), a visible region-absorbing dye capable of exhibiting supersensitization, a dye not exhibiting supersensitization, or a compound having no absorption in the visible region may be incorporated into the emulsion. Usable sensitizing dyes and substances exhibiting supersensitization in combination with the dye are described in Research Disclosure (hereinafter, also denoted as "RD") vol. 176, item 17643 (December, 1978) page 23, section IV-J; JP-B 49-15500 and 43-4933; and JP-A 59-19032, 3-15049 and 62-123454.

Techniques described in Research Disclosure No. 308119 (hereinafter, also denoted such as RD 308119) are applicable to the silver halide emulsions used in the invention, as shown below.

| Item | RD 308119 |
|---|---|
| Iodide | 993, I-A |
| Preparing method | 993, I-A; 994, I-E |
| Crystal habit (regular crystal) | 993, I-A |
| Crystal habit (twinned crystal) | 993, I-A |
| Epitaxial | 993, I-A |
| Halide composition (uniform) | 993, I-B |
| Halide composition (non-uniform) | 993, I-B |
| Halide conversion | 994, I-C |
| Halide substitution | 994, I-C |
| Metal occlusion | 994, I-D |
| Grain size distribution | 995, I-F |
| Solvent addition | 995, I-F |
| Latent image forming site (surface) | 995, I-G |
| Latent image forming site (internal) | 995, I-G |
| Photographic material (negative) | 995, I-H |
| Photographic material (positive) | 995, I-H |
| Emulsion blending | 995, I-J |
| Desalting | 995, II-A |

The silver halide emulsion according to the invention is subjected to physical ripening, chemical ripening and spectral sensitization. As additives used in these processes are shown compounds described in Research Disclosure No. 17643, No. 18716 and No. 308119 (hereinafter, denoted as RD 17643, RD 18716 and RD 308119), as below.

| Item | RD 308119 | RD 17643 | RD 18716 |
|---|---|---|---|
| Chemical Sensitizer | 996, III-A | 23 | 648 |
| Spectral Sensitizer | 996, IV-A-A,B,C, D,H,I,J | 23–24 | 648–9 |
| Super Sensitizer | 996, IV-A-E,J | 23–24 | 648–9 |
| Antifoggant | 998, VI | 24–25 | 649 |
| Stabilizer | 998, VI | 24–25 | 649 |

Photographic additives usable in the invention are also described, as below.

| Item | RD 308119 | RD 17643 | RD 18716 |
|---|---|---|---|
| Anti-staining agent | 1002, VII-I | 25 | 650 |
| Dye Image-Stabilizer | 1001, VII-J | 25 | |
| Whitening Agent | 998, V | 24 | |
| U.V. Absorbent | 1003, VIII-I, | 25–26 | |
| Light Absorbent | 1003, VIII | 25–26 | |
| light-Scattering Agent | 1003, VIII | | |
| Filter Dye | 1003, VIII | 25–26 | |
| Binder | 1003, IX | 26 | 651 |
| Antistatic Agent | 1006, XIII | 27 | 650 |
| Hardener | 1004, X | 26 | 651 |
| Plasticizer | 1006, XII | 27 | 650 |
| Lubricating Agent | 1006, XII | 27 | 650 |
| Surfactant, Coating aid | 1005, XI | 26–27 | 650 |
| Matting Agent | 1007, XVI | | |
| Developing Agent (included in photographic material) | 1001, XXB | | |

Exemplary examples of DIR compounds usable in this invention include compounds D-1 through D-34 described in JP-A 4-114153, which are preferably usable in this invention. Examples diffusible DIR compounds, in addition to the above compounds, include those which are described in U.S. Pat. Nos. 4,234,678, 3,227,554, 3,647,291, 3,958, 993, 4,419,886 and 3,933,500; JP-A 57-56837 and 51-13239; U.S. Pat. Nos. 2,072,363 and 2,070,266; and Research Disclosure December, 1981, item 21228.

A variety of couplers can be employed in the invention and examples thereof are described in research Disclosures described above. Relevant description portions are shown below.

| Item | RD 308119 | RD 17643 |
|---|---|---|
| Yellow coupler | 1001, VII-D | VII-C~G |
| Magenta coupler | 1001, VII-D | VII-C~G |
| Cyan coupler | 1001, VII-D | VII-C~G |
| Colored coupler | 1002, VII-G | VII-G |
| DIR coupler | 1001, VII-F | VII-F |
| BAR coupler | 1002, VII-F | |
| PUG releasing coupler | 1001, VII-F | |
| Alkali-soluble coupler | 1001, VII-E | |

Additives used in the invention can be added by dispersing methods described in RD 308119 XIV. In the invention are employed supports described in RD 17643, page 28; RD 18716, page 647–648; and RD 308119 XIX. In the photographic material according to the invention, there can be provided auxiliary layers such as a filter layer and interlayer, as described in RD 308119 VII-K, and arranged a variety of layer orders such as normal layer order, reverse layer order and unit layer arrangement.

Silver halide photographic light sensitive materials used in the invention can be processed by use of commonly known developing agents described in T. H. James, The Theory of the Photographic Process, Fourth edition, page 291 to 334; and Journal of American Chemical Society, 73, 3100 (1951), including, e.g., hydroquinone, p-aminophenol, N-methyl-p-aminophenol, 2,4-aminophenol, 2,4-diaminophenol as described in JP-A 4-15641; 1-phenyl-3-pyrazolidones such as 1-phenyl-3-pyrazolidone, 1-phenyl-4-methyl4-hydroxymethyl-3-pyrazolidone, and 5,5-dimethyl-1-phenyl-3-pyrazolidone and according the conventional method described in RD17643, pages 28–29, RD18716, page 615 and RD308119, XIX.

The thermally developable photothermographic materials used in invention will be described below.

Thermally developable photothermographic materials are disclosed, for example, in U.S. Pat. Nos. 3,152,904 and 3,457,075, and D. Morgan, "Dry Silver Photographic Material" and D. Morgan and B. Shely, "Thermally Processed Silver Systems" (Imaging Processes and Materials) Neblette, 8th Edition, edited by Sturge, V. Walworth, and A. Shepp, page 2, 1969), etc. Of these, the thermally developable photosensitive material used in the invention is characterized in that they are thermally developed at temperature of 80 to 140° C. so as to obtain images without fixation.

Silver halide grains work as a light sensor. In order to minimize cloudiness after image formation and to obtain excellent image quality, the less the average grain size, the more preferred, and the average grain size is preferably less than 0.1 $\mu$m, more preferably between 0.01 and 0.1 $\mu$m, and still more preferably between 0.02 and 0.08 $\mu$m. The average grain size as described herein is defined as an average edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain. Furthermore, silver halide grains are preferably monodisperse grains. The monodisperse grains as described herein refer to grains having a monodispersibility obtained by the formula described below of less than 40%; more preferably less than 30%, and most preferably from 0.1 to 20%.

Monodispersibility=(standard deviation of grain diameter)/(average grain diameter)×100(%)

The silver halide grain shape is not specifically limited, but a high ratio accounted for by a Miller index [100] plane is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

Furthermore, another preferred silver halide shape is a tabular grain. The tabular grain as described herein is a grain having an aspect ratio represented by r/h of at least 3, wherein r represents a grain diameter in μm defined as the square root of the projection area, and h represents thickness in μm in the vertical direction. Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved. The composition of silver halide may be any of silver chloride, silver chlorobromide, silver iodochlorobromide, silver bromide, silver iodobromide, or silver iodide.

Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Silver halide may be incorporated into the image forming layer by any means so that the silver halide is arranged so as to be close to reducible silver source. Silver halide may be mixed with a previously-prepared organic silver salt. Silver halide may be prepared by converting at least a part of the organic silver salt to silver halide through reaction of an organic acid with a halide ion silver halide, alternatively, silver halide which has been prepared may be added into a solution used for preparing an organic silver salt, and the latter is preferred. Silver halide is contained preferably in an amount of 0.75 to 30% by weight, based on an organic silver salt.

Silver halide preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex. Metal complex or metal complex ion usable in this invention, specifically, six-coordinate complexes represented by the general following formula are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different. Particularly preferred examples of M include rhodium (Rh), ruthenium (Ru), rhenium (Re), iridium (Ir) and osmium (Os).

Exemplary examples of transition metal ligand complexes are shown below, but are not limited to these.

1: $[RhCl_6]^{3-}$
2: $[RUCl_6]^{3-}$
3: $[ReCl_6]^{3-}$
4: $[RuBr_6]^{3-}$
5: $[OsCl_6]^{3-}$
6: $[IrCl_6]^{4-}$
7: $[Ru(NO)Cl_5]^{2-}$
8: $[RuBr_4(H_2O)]^{2-}$
9: $[Ru(NO)(H_2O)Cl_4]^{-}$
10: $[RhCl_5(H_2O)]^{2-}$
11: $[Re(NO)Cl_5]^{2-}$
12: $[Re(NO)(CN)_5]^{2-}$
13: $[Re(NO)Cl(CN)_4]^{2-}$
14: $[Rh(NO)_2Cl_4]^{-}$
15: $[Rh(NO)(H_2O)Cl_4]^{-}$
16: $[Ru(NO)(CN)_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl(TeCN)^{2-}$
23: $[Ru(NS)Cl_5]^{2-}$
24: $[Re(NS)Cl_4(SeCN)]^{2-}$
25: $[Os(NS)Cl(SCN)]_4]^{2-}$
26: $[Ir(NO)Cl_5]^{2-}$
27: $[Ir(NS)Cl_5]^{2-}$

One type of these metal ions or complex ions may be employed and the same type of metals or the different type of metals may be employed in combinations of two or more types. Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole. Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be non-uniformly occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution;

when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

The photosensitive silver halide grains used in the invention is preferably subjected to a chemical sensitization. As preferable chemical sensitizations, well known chemical sensitizations in this art such as a sulfur sensitization, a selenium sensitization and a tellurium sensitization are usable. Furthermore, a noble metal sensitization using gold, platinum, palladium and iridium compounds and a reduction sensitization are available. As the compounds preferably used in the sulfur sensitization, the selenium sensitization and the tellurium sensitization, well known compounds can be used and the compounds described in JP-A 7-128768 is usable.

Examples of the compounds used in the noble metal sensitization include chloroauric acid, potassium chloroaurate, potassium aurothiocyanate, gold sulfide, gold selenide, compounds described U.S. Pat. No. 2,448,060 and British Patent No. 618,061. Examples of the compounds used in the reduction sensitization include ascorbic acid, thiourea dioxide, stannous chloride, aminoiminomethanesulfinic acid, hydrazine derivatives, borane compounds, silane compounds and polyamine compounds. The reduction sensitization can be carried out by ripening an emulsion with keeping the pH and pAg at not less than 7 and not more than 8.3, respectively. Furthermore, the reduction sensitization can be carried out by introducing a silver ion alone at a time during the grain formation.

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, the ligand of which has a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidinic acid and stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form organic silver salt crystals. In this case, silver halide grains may be concurrently present.

In the present invention, organic silver salts have an average grain diameter of 2 $\mu$m or less and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.05 and 1.5 $\mu$m, and more preferably between 0.05 and 1.0 $\mu$m. Furthermore, the monodisperse as described herein is the same as silver halide grains and preferred monodispersibility is between 1 and 30%.

It is also preferred that at least 60% of the total of the organic silver salt is accounted for by tabular grains. The tabular grains refer to grains having a ratio of an average grain diameter to grain thickness, i.e., aspect ratio (denoted as AR) of 3 or more:

$$AR = \text{average diameter } (\mu m)/\text{thickness } (\mu m)$$

To obtain such tabular organic silver salts, organic silver salt crystals are pulverized together with a binder or surfactant, using a ball mill. Thus, using these tabular grains, photosensitive materials exhibiting high density and superior image fastness are obtained.

To prevent hazing of the photosensitive material, the total amount of silver halide and organic silver salt is preferably 0.5 to 2.2 g in equivalent converted to silver per $m^2$, leading to high contrast images. The amount of silver halide is preferably 50% by weight or less, more preferably 25% by weight or less, and still more preferably 0.1 to 15% by weight, based on the total silver amount.

Reducing agents are preferably incorporated into the thermally developable photosensitive material of the present invention. Examples of suitable reducing agents are described in U.S. Pat. Nos. 3,770,448, 3,773,512, and 3,593,863, and Research Disclosure Items 17029 and 29963, and include the following: aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines;

polyhydroxybenzenes (for example, hydroquinone, t-butylhydroquinone, isopropylhydroquinone, and (2,5-dihydroxy-phenyl)methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols. As hindered phenols, listed are compounds represented by the general formula (A) described below:

Formula (A)

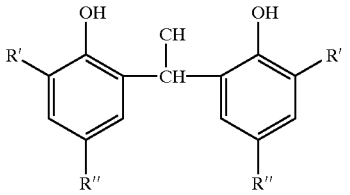

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Exemplary examples of the compounds represented by the formula (A) are shown below.

A-1

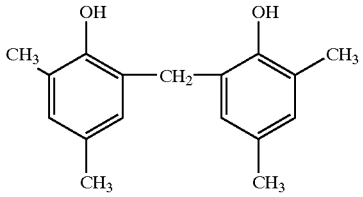

A-2

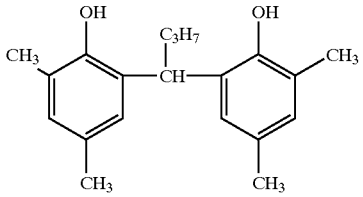

-continued

A-3

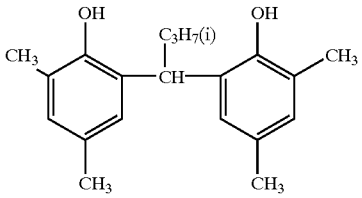

A-4

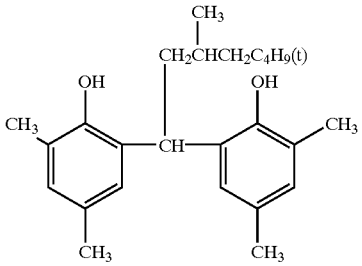

A-5

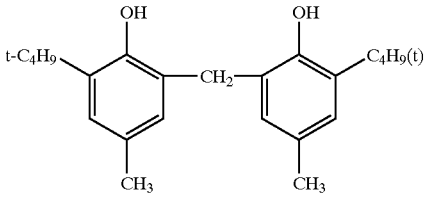

A-6

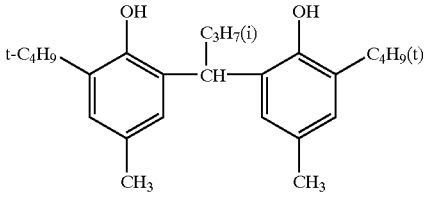

A-7

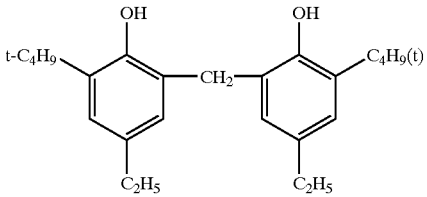

The used amount of reducing agents represented by the above-mentioned general formula (A) is preferably between $1\times10^{-2}$ and 10 moles, and is more preferably between $1\times10^{-2}$ and 1.5 moles per mole of silver.

Binders suitable for the thermally developable photosensitive material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly(methyl methacrylic acid), poly(vinyl chloride), poly(methacrylic acid), copoly(styrene-maleic acid anhydride), copoly (styrene-acrylonitrile, copoly(styrene-butadiene, poly(vinyl acetal) series [e.g., poly(vinyl formal)and poly(vinyl butyral), polyester series, polyurethane series, phenoxy resins, poly(vinylidene chloride), polyepoxide series, polycarbonate series, poly(vinyl acetate) series, cellulose esters, poly(amide) series. Of these binders are preferred aqueous-insoluble polymers such as cellulose acetate, cellulose acetate-butylate and poly(vinyl butyral); and poly(vinyl formal) and poly(vinyl butyral) are specifically preferred as a polymer used in the thermally developable photosensitive layer; and cellulose acetate and cellulose acetate-butylate are preferably used in a protective layer and backing layer.

A non-photosensitive layer may be provided on the photosensitive layer to protect the surface or prevent abrasion marks. Binder used in the non-photosensitive layer may be the same as or different from the binder used in the photosensitive layer.

The amount of the binder in a photosensitive layer is preferably between 1.5 and 6 $g/m^2$, and is more preferably between 1.7 and 5 $g/m^2$. The binder content of less than 1.5 $g/m^2$ tends to increase a density of unexposed area to levels unacceptable to practical use.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 30 per cent in weight ratio with respect to the total binder in the emulsion layer side. In cases where a non photosensitive layer is provided on the opposite side of the support to the photosensitive layer, it is preferred to incorporate a matting agent into at least one of the non-photosensitive layer (and more preferably, into the surface layer) in an amount of 0.5 to 40% by weight, based on the total binder on the opposite side to the photosensitive layer.

Materials of the matting agents employed in the present invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere having the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter)×100

The matting agent used in this present invention can be incorporated into any layer. In order to accomplish the object of the present invention, the matting agent is preferably incorporated into the layer other than the photosensitive layer, and is more preferably incorporated into the farthest layer from the support.

Addition methods of the matting agent include those in which a matting agent is previously dispersed into a coating composition and is then coated, and prior to the completion of drying, a matting agent is sprayed. When plural matting agents are added, both methods may be employed in combination.

The thermally developable photosensitive material according to the invention (hereinafter, also referred to as photothermographic material) comprises a support having thereon at least one photosensitive layer, and the photosensitive layer may only be formed on the support. Further, at least one non-photosensitive layer is preferably formed on the photosensitive layer. In order to control the amount or wavelength distribution of light transmitted through the photosensitive layer, a filter layer may be provided on the same side as the photosensitive layer, and/or an antihalation layer, that is, a backing layer on the opposite side. Dyes or pigments may also be incorporated into the photosensitive layer. As the usable dyes, those which can absorb aimed wavelength in desired wavelength region can be used, preferred are compounds described in JP-A Nos. 59-6481, 59-182436, U.S. Pat. No. 4,594,312, European Patent Publication Nos. 533,008, 652,473, JP-A Nos. 2-216140, 4-348339, 7-191432, 7-301890. Furthermore, these non-photosensitive layers may contain the above-mentioned binder, a matting agent and a lubricant such as a polysiloxane compound, a wax and liquid paraffin. The photosensitive layer may be composed of a plurality of layers. To adjust gradation, layers may be arranged in such a manner as a high-speed layer/low-speed layer or a low-speed layer/high-speed layer.

The photothermographic material used in this invention is a photographic material forming images upon thermal development. The photothermographic material comprises a reducible silver source (organic silver salt), photosensitive silver halide, a reducing agent, and optionally a toning agent modifying silver image tone, which are dispersed in an organic binder. The photothermographic materials are stable at ordinary temperatures but developable, after exposure, by heating at a high temperature (e.g., 80 to 140° C.). Heating leads to formation of silver through oxidation-reduction reaction between organic silver salt (which functions as an oxidizing agent) and reducing. The oxidation-reduction is catalyzed by a silver latent image produced in silver halide upon exposure. Silver produced as a result of reaction of the silver salt in the exposed region provides black images, which are in contrast with the unexposed region, leading to image formation. This reaction process proceeds without externally supplying a processing solution such as water.

Suitable image tone modifiers usable in the invention include those used in the invention b). Tone modifiers are preferably incorporated into the thermally developable photosensitive material used in the present invention. Examples of preferred tone modifiers, which are disclosed in Research Disclosure Item 17029, include the following:

imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred tone modifiers include phthalazone or phthalazine.

The photothermographic materials used in this invention may contain a mercapto compound, disulfide compound or thione compound to inhibit or accelerate development, to enhance spectral sensitization efficiency, or to enhance storage stability of the unprocessed photographic material.

In the present invention, to restrain or accelerate development for the purpose of controlling the development, to enhance the spectral sensitive efficiency, or to enhance the reservation stability before and after the development, a mercapto compound, a disulfide compound and a thione compound can be incorporated in the photosensitive material. In cases where the mercapto compound is used in the present invention, any compound having a mercapto group can be used, but preferred compounds are represented by the following formulas, Ar—SM and Ar—S—S—Ar, wherein M represents a hydrogen atom or an alkaline metal atom, Ar represents an aromatic ring compound or a condensed aromatic ring compound having at least a nitrogen, sulfur, oxygen, selenium or tellurium. Preferable aromatic heterocyclic ring compounds include benzimidazole, naphthoimidazole, benzothiazole, naphthothiazole, benzoxazole, naphthooxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazoline. These aromatic heterocyclic ring compounds may contain a substituent selected from a halogen atom (e.g., Br and Cl), a hydroxy group, an amino group, a carboxy group, an alkyl group (e.g., alkyl group having at least a carbon atom, preferably 1 to 4 carbon atoms) and an alkoxy group (e.g., alkoxy group having at least a carbon atom, preferably 1 to 4 carbon atoms). Examples of mercapto-substituted aromatic heterocyclic ring compounds include 2-mercaptobenzimidazole, 2-mercaptobenzoxazole, 2-mercaptobenzothiazole, 2-mercapto-5-methylbenzothiazole, 3-mercapto-1,2,4-triazole, 2-mercaptoquinoline, 8-mercaptopurine, 2,3,5,6-tetrachloro-4-pyridinethiol, 4-hydroxy-2-mercaptopyrimidine and 2-mercapto-4-phenyloxazole, but the exemplified compounds according to the present invention are not limited thereto.

Antifoggants may be incorporated into the thermally developable photothermographic material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and JP-A 59-57234. Particularly preferred mercury-free antifoggants are heterocyclic compounds having at least one substituent, represented by—C(X1)(X2)(X3) (wherein X1 and X2 each represent halogen, and X3 represents hydrogen or halogen), as disclosed in U.S. Pat. Nos. 3,874,946 and 4,756,999; As examples of suitable antifoggants, employed preferably are compounds described in paragraph numbers [0030] through [0036] of JP-A 9-288328. Further, as another examples of suitable antifoggants, employed preferably are compounds described in paragraph numbers [0062] and [0063] of JP-A 9-90550. Furthermore, other suitable antifoggants are disclosed in U.S. Pat. No. 5,028,523, and European Patent 600,587; 605,981 and 631,176.

In the photothermographic material, can be employed sensitizing dyes described, for example, in JP-A Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978). Particularly, selected can advantageously be sensitizing dyes having the spectral sensitivity suitable for spectral characteristics of light sources of various types of scanners. For example, compounds described in JP-A Nos. 9-34078, 9-54409 and 9-80679 are preferably employed.

Various kinds of additives can be incorporated into a photosensitive layer, a non-photosensitive layer or other construction layers. Except for the compounds mentioned above, surface active agents, antioxidants, stabilizers, plasticizers, UV (ultra violet rays) absorbers, covering aids, etc. may be employed in the thermally developable photosensitive material according to the present invention. These additives along with the above-mentioned additives are described in Research Disclosure Item 17029 (on page 9 to 15, June, 1978) and can be employed.

Supports employed in the present invention are preferably, in order to minimize the deformation of images after development processing, plastic films (for example, polyethylene terephthalate, polycarbonate, polyimide, nylon, cellulose triacetate, polyethylene naphthalate). The thickness of the support is between about 50 and about 300 $\mu$m, and is preferably between 70 and 180 $\mu$m. Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point, preferably by not less than 35° C. and more preferably by at least 40° C. However, when the supports are heated at a temperature higher than the melting point, no advantages of the present invention are obtained. Commonly known casting methods and subbing methods are applicable to the support used in the invention, as described in JP-A 9-50094, items [0030]–[0070].

To improve an electrification property, a conducting compound such as a metal oxide and/or a conducting polymer can be incorporated into a construction layer. These compounds can be incorporated into any layer, preferably into a sublayer, a backing layer and an intermediate layer between a photosensitive layer and a sublayer, etc. In the present invention, the conducting compounds described in U.S. Pat. No. 5,244,773, column 14 through 20, are preferably used.

EXAMPLES

The present invention will be explained based on examples, but embodiments of the invention are not limited to these.

Example 1

Preparation of Photographic Material Sample 101

On a subbed cellulose triacetate film were coated the following compositions to prepare photographic material Sample 101. Unless otherwise noted, the addition amount of each compound was represented in term of g/m$^2$, provided that the amount of silver halide or colloidal silver was converted to the silver amount and the amount of a sensitizing dye was represented in mol/Ag mol.

| | |
|---|---|
| 1st Layer: Anti-Halation Layer | |
| Black colloidal silver | 0.18 |
| UV absorbent (UV-1) | 0.30 |
| High boiling solvent (Oil-2) | 0.17 |
| Gelatin | 1.59 |
| 2nd Layer: Intermediate Layer | |
| High boiling solvent (Oil-2) | 0.01 |
| Gelatin | 1.27 |
| 3rd Layer: Infrared-sensitive Layer | |
| Silver iodobromide emulsion A | 0.15 |

-continued

| | |
|---|---|
| Silver iodobromide emulsion B | 0.70 |
| Additive (as shown in Table 1) | $2.0 \times 10^{-6}$ |
| Sensitizing dye (as shown in Table 1) | $5.0 \times 10^{-5}$ |
| Magenta coupler (M-1) | 0.20 |
| High boiling solvent (Oil-1) | 0.34 |
| Gelatin | 0.90 |
| 4th Layer: First Protective Layer | |
| Silver iodobromide emulsion (av. 0.04 μm, I:4.0 mol%) | 0.30 |
| UV absorbent (UV-2) | 0.03 |
| UV absorbent (UV-3) | 0.015 |
| UV absorbent (UV-4) | 0.015 |
| UV absorbent (UV-5) | 0.015 |
| UV absorbent (UV-6) | 0.10 |
| High boiling solvent (Oil-1) | 0.44 |
| High boiling solvent (Oil-3) | 0.07 |
| Gelatin | 1.35 |
| 5th Layer: Second protective Layer | |
| Alkali-soluble matting agent (Av. Particle size of 2 μm) | 0.15 |
| Polymethyl methacrylate (av. Particle size of 3 μm) | 0.04 |
| Lubricant (WAX-1) | 0.02 |
| Gelatin | 0.54 |

In addition to the above compositions, compounds Su-1, Su-2, SU-3 and SU-4; viscosity-adjusting agent V-1; hardeners H-1 and H-2; stabilizer ST-1; antifoggant AF-1 and AF-2, and AF-3 having a weight-averaged molecular weight of 10,000 and 100,000; dyes AI-1, AI-2 and AI-3; compounds FS-1 and FS-2; and antiseptic agent DI-1 were optimally added to each layer.

TABLE 55

M-1

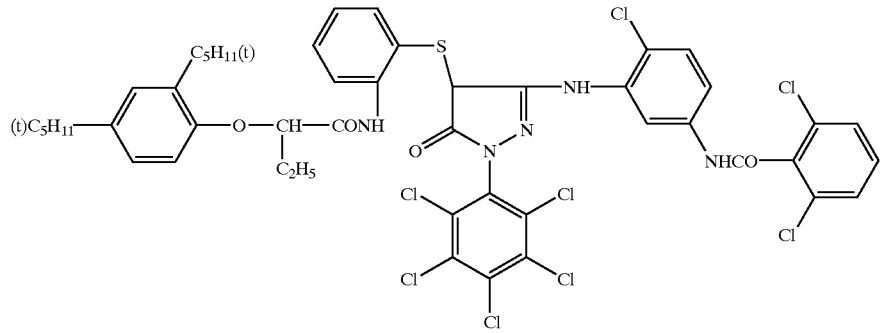

Oil-1

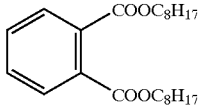

Oil-2

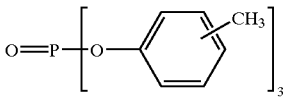

Oil-3

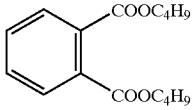

UV Absorbent

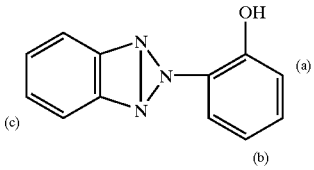

(a) (b) (c)

TABLE 55-continued
| | | | |
|---|---|---|---|
| UV-1 | —$C_{12}H_{25}$ | —$CH_3$ | —H |
| UV-2 | —H | —(t)$C_4H_9$ | —H |
| UV-3 | —(t)$C_4H_9$ | —(t)$C_4H_9$ | —H |
| UV-4 | —(t)$C_4H_9$ | —$CH_3$ | —Cl |
| UV-5 | —(t)$C_4H_9$ | —(t)$C_4H_9$ | —Cl |
UV-6
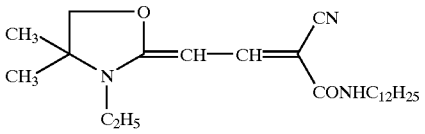
WAX-1
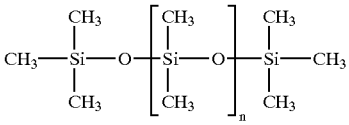
Weight-average molecular weight MW:3,000
SU-1
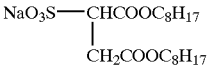
SU-2
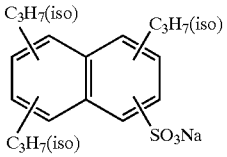
SU-3
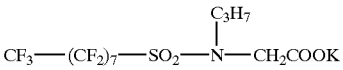
SU-4
$C_8F_{17}$—$SO_2NH$—$(CH_2)_3$—$N^+(CH_3)_3.Br^-$
FS-1
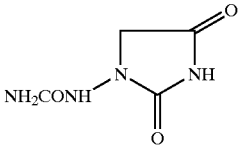
FS-2
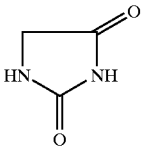
Al-1
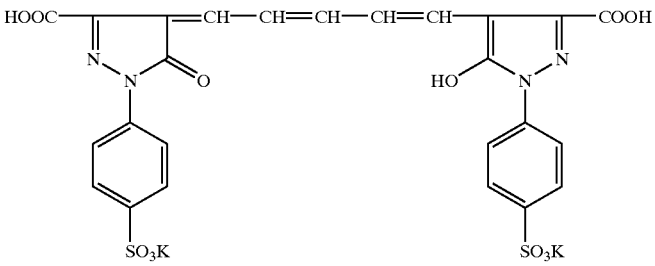
Al-2
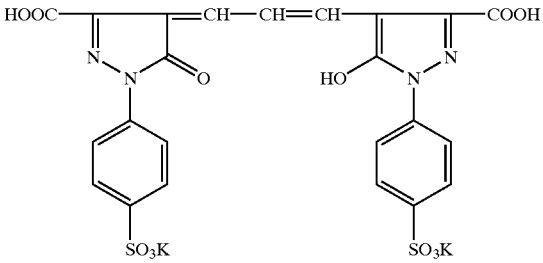

TABLE 55-continued
Al-3
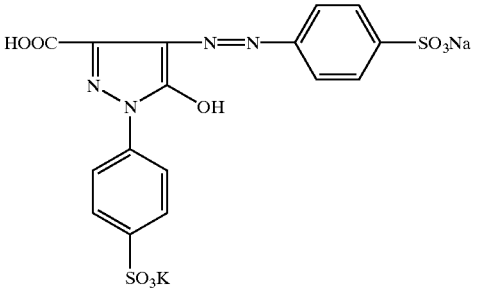
V-1
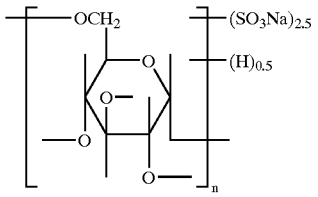
Weight-average molecular weight MW:120,000
H-1
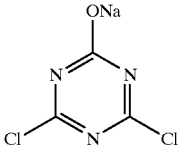
H-2 $(CH_2{=}CHSO_2CH_2)_2O$
ST-1
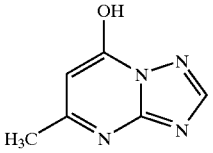
AF-1
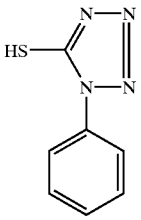
AF-2
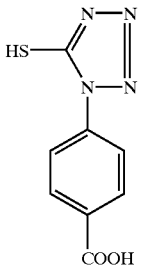
AF-3
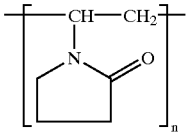
Weight-average molecular weight MW:10,000
Weight-average molecular weight MW:100,000
DI-1 (mixture)
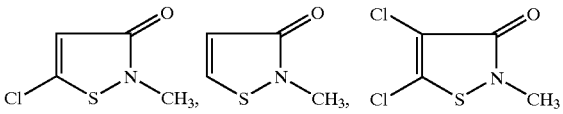
A B C
A:B:C = 50:46:4 (molar ratio)

TABLE 55-continued

SS-1

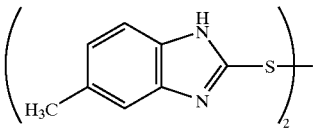

SS-2

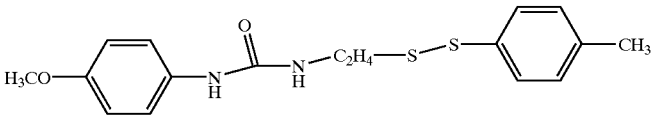

SS-3

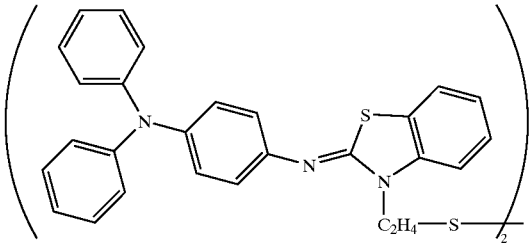

Dye-A

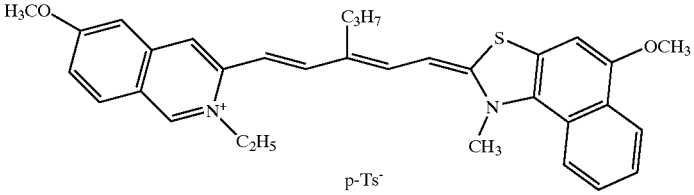

Characteristics of silver iodobromide emulsions described above are shown below, in which the average grain size refers to an edge length of a cube having the same volume as that of the grain. Each emulsion was subjected to gold, sulfur and selenium sensitization.

| Emulsion | Av. AgI Content (mol%) | Av. Grain Size (μm) | Crystal Habit | Diameter/Thickness |
|---|---|---|---|---|
| A | 6.0 | 0.60 | Twinned Tabular | 4.0 |
| B | 8.0 | 0.90 | Twinned Tabular | 3.0 |

Preparation of Photographic Material Samples 102 to 128

Samples 102 to 128 were prepared in a manner similar to Sample 101, except that additive SS-1 (comparative compound) and sensitizing dye Dye-A (comparative dye) used in the 3rd layer were each replaced by an equimolar amount of a dye or compound, as shown in Table 1.

Evaluation of Sensitivity and Fog of Color Negatives

Samples 101 to 124 were cut to a size according to the 135-standard and exposed to infrared light for 1/100 sec., using Kodak Wratten filter 89B under the following conditions, then subjected to color processing (CNK-4, available from Konica Corp.)

Condition A: 23° C., 55% RH, 4 days

Condition B: 40° C., 80% RH, 4 days.

Each sample was evaluated with respect to sensitivity and fogging.

Evaluation Method

Fog Density

The fog density was represented by a green light transmission density value measured by using PD transmission type densitometer (available from Konica Corp.), as shown in Table 1.

Sensitivity

Sensitivity was represented by a relative value of reciprocal of exposure necessary to give a density of a fog density plus 0.15, based the sensitivity of Sample 101 which was exposed under the condition A being 100.

Variation of Sensitivity with Temperature on Exposure

The ratio of sensitivity ΔSp (=SCB/SiA) was used as a measure of variation of sensitivity with humidity on exposure, in which SiA is sensitivity of a sample exposed under the condition A and SCB is sensitivity of a sample exposed under the condition B. The ΔSp closer to 1 is less sensitivity variation, indicating being superior.

Results are shown in Table 1.

TABLE 1

| Sample | Additive | Dye | Fog | SiA | ΔSp | Remark |
|---|---|---|---|---|---|---|
| 101 | SS-1 | Dye-A | 0.12 | 100 | 0.66 | Comp. |
| 102 | SS-2 | Dye-A | 0.09 | 103 | 0.72 | Comp. |
| 103 | SS-3 | Dye-A | 0.11 | 108 | 0.69 | Comp. |
| 104 | 2 | Dye-A | 0.08 | 109 | 0.88 | Inv. |
| 105 | 4 | Dye-A | 0.09 | 107 | 0.82 | Inv. |
| 106 | 17 | Dye-A | 0.07 | 110 | 0.86 | Inv. |
| 107 | 41 | Dye-A | 0.07 | 112 | 0.89 | Inv. |
| 108 | SS-1 | No.29 | 0.08 | 122 | 0.84 | Comp. |

TABLE 1-continued

| Sample | Additive | Dye | Fog | SiA | ΔSp | Remark |
|---|---|---|---|---|---|---|
| 109 | SS-2 | No.29 | 0.07 | 123 | 0.85 | Comp. |
| 110 | SS-3 | No.29 | 0.07 | 125 | 0.82 | Comp. |
| 111 | 2 | No.29 | 0.06 | 130 | 0.98 | Inv. |
| 112 | 4 | No.29 | 0.06 | 126 | 0.97 | Inv. |
| 113 | 17 | No.29 | 0.06 | 127 | 0.98 | Inv. |
| 114 | 41 | No.29 | 0.06 | 133 | 0.98 | Inv. |
| 115 | SS-1 | No.30 | 0.09 | 126 | 0.86 | Comp. |
| 116 | SS-2 | No.30 | 0.07 | 127 | 0.87 | Comp. |
| 117 | SS-3 | No.30 | 0.08 | 129 | 0.83 | Comp. |
| 118 | 2 | No.30 | 0.06 | 133 | 0.99 | Inv. |
| 119 | 4 | No.30 | 0.06 | 130 | 0.97 | Inv. |
| 120 | 17 | No.30 | 0.06 | 132 | 0.98 | Inv. |
| 121 | 41 | No.30 | 0.06 | 135 | 0.98 | Inv. |
| 122 | SS-1 | No.52 | 0.09 | 116 | 0.81 | Comp. |
| 123 | SS-2 | No.52 | 0.07 | 119 | 0.85 | Comp. |
| 124 | SS-3 | No.52 | 0.08 | 120 | 0.84 | Comp. |
| 125 | 2 | No.52 | 0.06 | 123 | 0.97 | Inv. |
| 126 | 4 | No.52 | 0.07 | 121 | 0.96 | Inv. |
| 127 | 17 | No.52 | 0.08 | 123 | 0.98 | Inv. |
| 128 | 41 | No.52 | 0.07 | 125 | 0.98 | Inv. |

As apparent from Table 1, silver halide photographic materials according to the invention exhibited superior performance such as high sensitivity, low fog and reduced variation of sensitivity with humidity.

Example 2

Preparation of a Subbed PET Photographic Support

Both surfaces of a biaxially stretched thermally fixed 175 μm PET film, available on the market, was subjected to corona discharging at 8 w/m$^2$·min. Onto the surface of one side, the subbing coating composition a-1 described below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

Subbing Coating Composition a-1

| | |
|---|---|
| Latex solution (solid 30%) of a copolymer consisting of butyl acrylate (30 weight %), t-butyl acrylate (20 weight %) styrene (25 weight %) and 2-hydroxyethyl-acrylate (25 weight %) | 270 g |
| (C-1) | 0.6 g |
| Hexamethylene-1,6-bis(ethyleneurea) | 0.8 g |
| Water to make | 1 liter |

Subbing Coating Composition b-1

| | |
|---|---|
| Latex liquid (solid portion of 30%) of a copolymer consisting of butyl acrylate (40 weight %) styrene (20 weight %) glycidyl acrylate (25 weight %) | 270 g |
| (C-1) | 0.6 g |
| Hexamethylene-1,6-bis(ethyleneurea) | 0.8 g |
| Water to make | 1 liter |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.8 μm, which was designated Subbing Layer A-2, while onto the Subbing Layer B-1, the upper subbing layer coating composition b-2 was applied so at to form a dried layer thickness of 0.8 μm, having a static preventing function, which was designated Subbing Upper Layer B-2.

Upper Subbing Layer Coating Composition a-2

| | |
|---|---|
| (C-1) | 0.2 g |
| (C-2) | 0.2 g |
| (C-3) | 0.1 g |
| Silica particles (av. size 3 μm) | 0.1 g |
| Water to make | 1 liter |

Upper Subbing Layer Coating Composition b-2

| | |
|---|---|
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

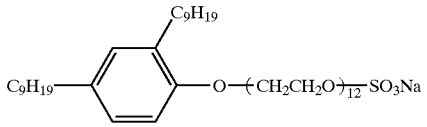

(C-2)

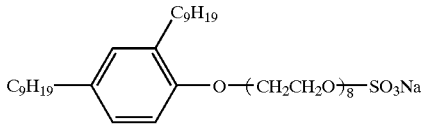

(C-3)

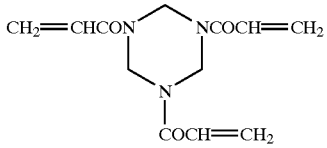

(C-4)

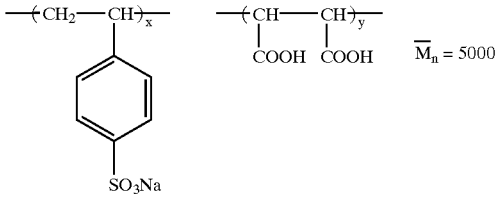

($\overline{M}$n is a number average molecular weight)
x:y = 75:25 (weight ratio)

(C-5)

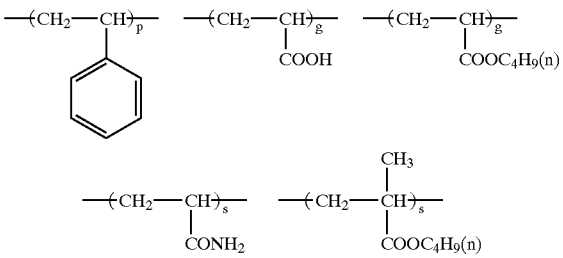

p:g:r:s:t = 40:5:10:5:40 (weight ratio)

-continued (C-6)

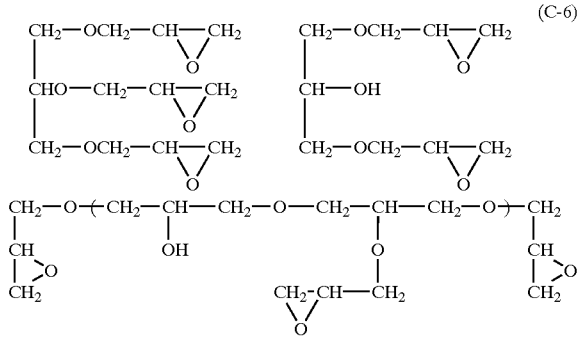

Mixture Consisting of the Three Compounds Illustrated Above

Thermal Treatment of Support

The subbed support was dried at 140° C. in the process of subbing and drying a support.

Preparation of Silver Halide Emulsion

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an aqueous equimolar halide solution containing potassium bromide and potassium iodide (in a molar ratio of 98 to 2), $1\times10^{-6}$ mol/mol Ag of $Ir(NO)Cl_5$ and $1\times10^{-6}$ of rhodium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 11 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion.

Preparation of Sodium Behenate

In 945 ml water at 90° C. were dissolved 32.4 g of behenic acid, 9.9 g of arachidic acid and 5.6 g of stearic acid. Aqueous 1.5M sodium hydroxide solution of 98 ml was added thereto, while stirring at high speed. Then, after adding 0.93 ml of concentrated nitric acid, the reaction mixture was cooled to 55° C. and stirred for 30 min. to obtain a sodium behenate aqueous solution.

Preparation of Pre-formed Emulsion of Silver Behenate and Silver Halide Emulsion To the sodium behenate solution was added 15.1 g of the silver halide emulsion. After adjusting the pH at 8.1 with aqueous sodium hydroxide solution, 147 ml of aqueous 1M silver nitrate solution was added in 7 min. After stirring for 20 min., the reaction mixture was subjected ultrafiltration to remove soluble salts. Thus prepared silver behenate dispersion was comprised of monodisperse particles having an average size of 0.8 μm. The dispersion was flocculated and water was removed and washing and removal of water were further repeated six times and dried.

Preparation of Photosensitive Emulsion

To the pre-formed emulsion, 544 g of a methyl ethyl ketone (MEK) solution of polyvinyl butyral (average molecular weight of 3,000 and 17 wt %) and 107 g toluene was gradually added with mixing and dispersed at a rate of 280 kgf/cm$^2$.

Backing-side Coating

A coating solution for a backing layer of the following composition was coated by an extrusion coater on the side of B-2 layer of the support so as to have a wet thickness of 30 μm and dried at 60° C. for 3 min.

Backing Layer

| | |
|---|---|
| Cellulose acetate (10% methyl ethyl ketone solution) | 15 ml/m$^2$ |
| Dye-B | 7 mg/m$^2$ |
| Dye-C | 7 mg/m$^2$ |
| Matting agent, monodispersed silica having monodispersity of 15% and a mean size of 10 μm | 30 mg/m$^2$ |
| $C_9H_{19}$—$C_6H_4$—$SO_3Na$ | 10 mg/m$^2$ |

Dye-B

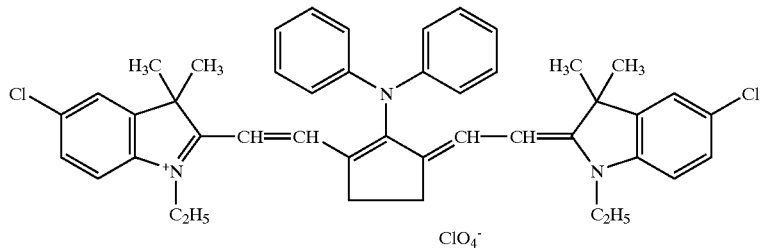

-continued

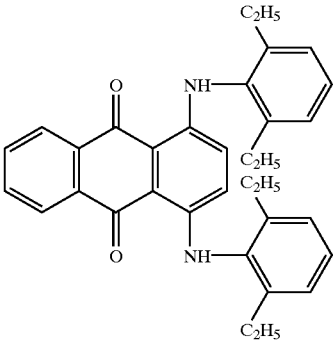

Dye-C

Emulsion Side Coating

Photosensitive Layer 1

On the sub-layer A-2 side of the support, a photosensitive layer having the following composition and, further thereon, a protective layer were coated so as to have silver coverage of 2.4 g/m$^2$, and thereafter dried at 55° C. in 15 min. Photographic material Samples 2-1 to 2-20 were thus obtained. The amount of the additive is represented by moles per mol of silver halide.

Photosensitive Layer Coating Solution

| | |
|---|---|
| Photosensitive emulsion | 240 g |
| Additive (as shown in Table 2) | $6.4 \times 10^{-4}$ |
| Sensitizing dye (as shown in Table 2) (0.1% methanol solution) | 1.7 ml |
| Pyridinium bromide perbromide (6% methanol solution) | 3 ml |
| Calcium bromide (0.1% methanol solution) | 1.7 ml |
| Antifoggant-2 (10% methanol solution) | 1.2 ml |
| 2-(4-Chlorobenzoyl)-benzoic acid (12% methanol solution) | 9.2 ml |
| 2-Mercaptobenzimidazole (1% methanol solution) | 11 ml |
| Tribromethylsulfoquinoline (5% methanol solution) | 17 ml |
| Reducing agent A-3 (20% methanol solution) | 29.5 ml |
| Phthalazinone | 0.6 g |
| 4-Methylphthalic acid | 0.25 g |
| Tetrachlorophthalic acid | 0.2 g |

Surface Protective Layer Coating Solution

| | |
|---|---|
| Acetone | 5 ml/m$^2$ |
| Methyl ethyl ketone | 21 ml/m$^2$ |
| Cellulose acetate | 2.3 g/m$^2$ |
| Methanol | 7 ml/m$^2$ |
| Phthalazinone | 250 mg/m$^2$ |
| Matting agent, monodisperse silica having monodispersity of 10% and a mean size of 4 $\mu$m | 70 mg/m$^2$ |
| $CH_2{=}CHSO_2CH_2CH_2OCH_2CH_2SO_2CH{=}CH_2$ | 35 mg/m$^2$ |
| Spot-preventing agent | 50 mg/m$^2$ |
| $C_9F_{19}{-}C_6H_4{-}SO_3Na$ | 10 mg/m$^2$ |

Antifoggant 2

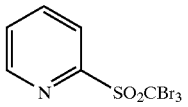

Spot-preventing Agent

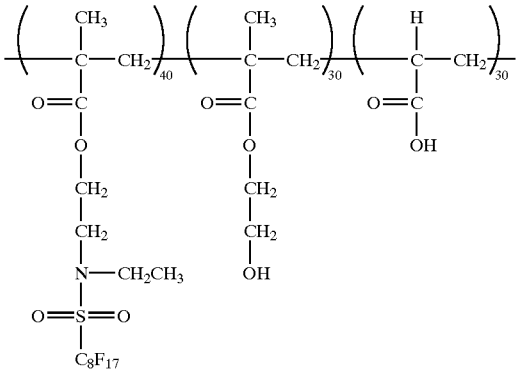

Exposure and Processing

The thus prepared thermally developable photothermographic material samples were each exposed to laser light using an imager having a semiconductor laser of 810 nm under the condition A or B; and the exposed photothermographic material samples were subjected to thermal development at 110° C. for 15 sec. Development was conducted in an environment maintained at 23° C. and 50% RH:

Condition A: 23° C., 55% RH, 4 days

Condition B: 40° C., 80% RH, 4 days.

Fog Density

Unexposed areas of the thus developed samples were measured and the transmission density thereof is shown as a fog density in Table 2.

Sensitivity

Sensitivity was represented by relative value of reciprocal of exposure necessary to a density of a fog density plus 1.0, based on the sensitivity of Sample 2-1 exposed under the condition A (SiA) being 100.

Variation of Sensitivity with Temperature on Exposure

The ratio of sensitivity ΔSp (=SCB/SiA) was used as a measure of variation of sensitivity with humidity on exposure, in which SiA is sensitivity of a sample exposed under the condition A and SCB is sensitivity of a sample exposed under the condition B. The ΔSp closer to 1 is less sensitivity variation, indicating being superior.

Results are shown in Table 2.

TABLE 2

| Sample | Additive | Dye | Fog | SiA | ΔSp | Remark |
|---|---|---|---|---|---|---|
| 2-1 | SS-4 | No.43 | 0.10 | 100 | 0.82 | Comp. |
| 2-2 | SS-5 | No.43 | 0.09 | 103 | 0.83 | Comp. |
| 2-3 | SS-6 | No.43 | 0.11 | 101 | 0.80 | Comp. |
| 2-4 | 6 | No.43 | 0.10 | 104 | 0.98 | Inv. |
| 2-5 | 35 | No.43 | 0.09 | 109 | 0.99 | Inv. |
| 2-6 | 14 | No.43 | 0.10 | 102 | 0.97 | Inv. |
| 2-7 | 19 | No.43 | 0.09 | 105 | 0.98 | Inv. |
| 2-8 | 10 | No.43 | 0.09 | 118 | 0.98 | Inv. |
| 2-9 | 22 | No.43 | 0.09 | 113 | 0.98 | Inv. |
| 2-10 | SS-4 | No.44 | 0.12 | 93 | 0.84 | Comp. |
| 2-11 | SS-5 | No.44 | 0.12 | 97 | 0.83 | Comp. |
| 2-12 | SS-6 | No.44 | 0.11 | 95 | 0.85 | Comp. |
| 2-13 | 6 | No.44 | 0.11 | 99 | 0.98 | Inv. |
| 2-14 | 35 | No.44 | 0.09 | 102 | 0.98 | Inv. |
| 2-15 | 14 | No.44 | 0.10 | 99 | 0.97 | Inv. |
| 2-16 | 19 | No.44 | 0.10 | 101 | 0.98 | Inv. |
| 2-17 | 35 | No.53 | 0.09 | 105 | 0.98 | Inv. |
| 2-18 | 19 | No.53 | 0.10 | 103 | 0.98 | Inv. |
| 2-19 | 10 | No.53 | 0.09 | 113 | 0.98 | Inv. |
| 2-20 | 22 | No.53 | 0.10 | 108 | 0.99 | Inv. |

SS-4

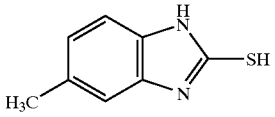

SS-5

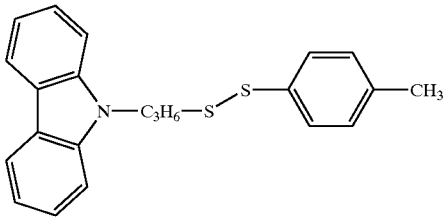

SS-6

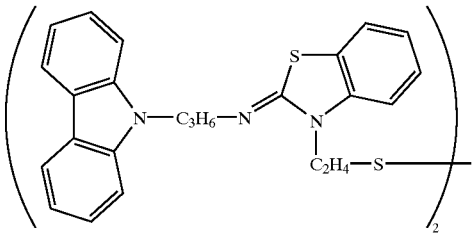

As apparent from Table 2, silver halide photographic materials according to the invention exhibited superior performance such as high sensitivity, low fog and reduced variation of sensitivity with humidity.

Example 3

Preparation of Silver Halide Grains 3-1

In 700 ml of water were dissolved 21 g of phthalated gelatin and 30 mg of potassium bromide. After adjusting the temperature and the pH to 40° C. and 5.0, respectively, 159 ml of an aqueous solution containing 18.6 g silver nitrate and 159 ml of an aqueous equimolar halide solution containing potassium bromide and potassium iodide (in a molar ratio of 98 to 2) were added by the controlled double jet addition in 10 min., while maintaining the pAg at 7.7. Subsequently, 476 ml of an aqueous solution containing 55.4 g silver nitrate and aqueous solution containing 9 μmole/l of $K_2IrCl_6$ and 1 mole/l of potassium bromide were added by the controlled double jet addition in 30 min., while maintaining the pAg at 7.7. Thereafter, the resulting emulsion was flocculated to remove soluble salts, employing a flocculating agent and after desalting, 0.1 g of phenoxyethanol was added and the pH and pAg were adjusted to 5.9 and 8.0, respectively to obtain silver halide emulsion. There was obtained cubic silver iodobromide grains having a 8 mol % iodide containing core, an average overall iodide content of 2 mol %, an average grain size of 0.06 μm, a variation coefficient of the projection area equivalent diameter of 9, and the proportion of the {100} face of 85%.

The thus obtained silver halide grain emulsion was heated to 60° C. and ripened for a period of 120 min. with 85 μmol of sodium thiosulfate, 11 μmol of 2,3,4,5,6-pentafluorophenyldiphenylphosphine selenide, 2 μmol of compound 1, 3.3 μmol of chloroauric acid and 230 μmol of thiocyanic acid, each per mol of silver. Thereafter, the temperature was lowered to 50° C., then, $5\times10^{-4}$ mol/mol Ag of sensitizing dye A and $2\times10^{-4}$ mol/mol Ag of sensitizing dye B were added thereto with stirring. Subsequently was added thereto potassium iodide of 3.5 mol %, based on silver and after stirring for 30 min., the emulsion was cooled to 30° C. to obtain silver halide grain emulsion 3-1 used for Sample 3-1. Silver halide grain emulsions 3-2 through 3-12 used for Samples 3-2 through 3-12 were each prepared in a manner similar to the emulsion 3-1, except that sensitizing dyes A and B were replaced by dyes, as shown in Table 3.

Preparation of Organic Silver Salt Microcrystal Dispersion

Behenic acid of 40 g, stearic acid of 7.3 g were stirred with 500 ml water at 90° C. for 15 min. and 187 ml of an aqueous 1 mol/l sodium hydroxide solution was added thereto in 15 min., then, 60 ml of an aqueous 1 mol/l silver nitrate solution was further added and the temperature was lowered to 50° C. Subsequently, 124 ml of an aqueous 1 mol/l silver nitrate solution was added thereto in 2 min. and further stirred for 30 min. The solid product was filtered using a suction funnel and then subjected to water washing until the conductivity of the filtrate reached 30 μS/cm.

The thus obtained solid was treated in a wet cake form, without being dried. To the wet cake equivalent to 34.8 g of dried solid, 120 g of polyvinyl alcohol and 150 ml water were added with stirring to form slurry. The slurry was added into a vessel together with 840 g of zirconia beads having an average diameter of 0.5 mm and dispersed for 5 hrs. by a dispersing machine (¼ Sand Grinder Mill, available from IMEX Co. Ltd.) to obtain an organic silver salt microcrystal dispersion. As a result of electronmicroscopic observation, the dispersion was comprised of needle crystals having a mean breadth of 0.05 μm, a mean length of 0.9 μm and a variation coefficient of the projected area of 35%.

Preparation of Tone Modifier Fine Particle Dispersion 1

To 2.9 g of 4-methylphthalic acid and 2.1 g of phthalazinone, 2 g of hydroxypropyl cellulose and 93 g water were added with stirring and allowed to stand for 10 hrs. The obtained slurry was added into a vessel together with 168 g of zirconia beads having an average diameter of 0.5 mm and dispersed for 10 hrs. by the same dispersing machine as used in the preparation of the organic silver salt microcrystal dispersion to obtain a solid fine particle dispersion 1 of 4-methylphthalic acid and phthalazinone, in which 70% by weigh was accounted for. by fine particles having a size of not more than 1.0 μm.

Preparation of Tone Modifier Fine Particle Dispersion 2

To 2.4 g of 4-methylphthalic acid 1.8 g of phthalazinone and 0.8 g of tetrachlorophthalic acid, 2 g of hydroxypropyl cellulose and 93 g water were added with stirring and allowed to stand for 10 hrs. The obtained slurry was added into a vessel together with 168 g of zirconia beads having an average diameter of 0.5 mm and dispersed for 10 hrs. by the same dispersing machine as used in the preparation of the tone modifier solid particle dispersion 1 to obtain a solid fine particle dispersion 2 of 4-methylphthalic acid, phthalazinone and tetrachlorophthalic acid, in which 70% by weigh was accounted for by fine particles having a size of not more than 1.0 μm.

Preparation of Emulsion Coating Solution

To the obtained organic silver salt microcrystal dispersion (equivalent to 1 mol silver) were added the silver halide grains obtained as above in an amount of 10 mol % of the organic silver salt and chemicals of 430 g of Laxter3307B (SBR latex, available from Dainippon Ink Kagaku Kogyo Co. Ltd.), 98 g of 1,1-bis(2-hydroxy-3,5-dimethylphenyl)-3,5,5-trimethylhexane (reducing agent, A-4), 9.2 g of tone modifier solid particle dispersion 1, 7 g of tone modifier solid particle dispersion 2, comparative compound SS-7 (15.2 mmol) and copper phthalocyanine (β-type), as an anti-irradiation dye in an amount necessary to make the absorbance at the exposure wavelengths 0.3. There was thus obtained emulsion coating solution 3-1 used for Sample 3-1.

Emulsion coating solutions 3-2 through 3-12 used for Sample 3-2 through 3-12 were each prepared in a manner similar to the emulsion coating solution 3-1, except that the silver halide grain emulsion was replaced by each of emulsion 3-2 through 3-12 and the additive was replaced by the compound shown in Table 3.

Laxter 3307B is a latex of styrene-butadien copolymer having a mean particle size of 0.1 to 0.15 μm. The equilibrium moisture content of the polymer at 25° C. and 60% RH was 0.6% by weight.

Preparation of Coating Solution of Emulsion-Protective Layer

To 10 g of inert gelatin, 0.26 g of surfactant A and 0.09 g of surfactant B, 0.9 g of fine silica paricles (having an average size of 2.5 μm)0.3 g of 1,2-bis (vinylsulfonylacetoamido)ethane and 64 g water were added and dispersed to obtain a coating solution of an emulsion-protective layer.

Preparation of Color Former Dispersion

In 35 g of ethyl acetate, compound 1 and 2 were dissolved in amounts of 2.5 g and 7.5 g, respectively with stirring. To this solution, 50 g of an aqueous 10 wt % polyvinyl alcohol solution was added and stirred for 5 min. by a homogenizer. Thereafter, ethyl acetate was removed through volatilization and the residue was diluted with water to obtain a color former dispersion.

Preparation of Back-side Coating Solution

The thus obtained color former dispersion of 50 g, 20 g of compound 3, 250 g water and 1.8 g of Sildex H121 (available from Dokai Kagaku-sha, and comprised of spherical particles having a mean size of 12 μm) were added to 30 g of polyvinyl alcohol to obtain a back-side coating solution.

Preparation of Coated Sample

Emulsion coating solutions 3-1 through 3-12 were each coated on a 175 μm blue-tinted polyethylene terephthalate film support so that the silver coating amount was 1.9 g/m2, and further thereon, the emulsion-protective layer coating solution was coated in a gelatin coating amount of 1.8 g/m2. After being dried, the back-side coating solution was coated on the opposite side of the support to the emulsion layer so that the optical density at 660 nm was 0.7. Photothermographic material samples 3-1 through 3-14 were thus obtained.

Tellurium compound 1

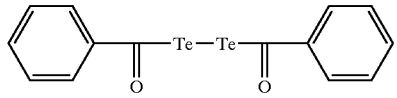

Sensitizing dye A

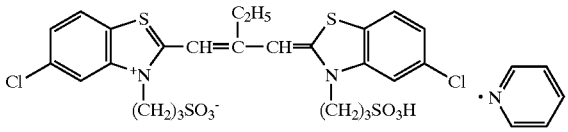

Sensitizing dye B

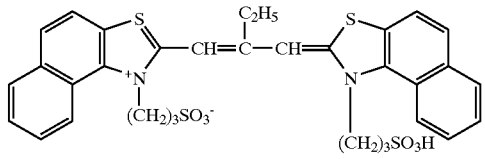

Surfactant A

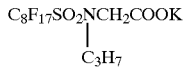

Surfactant B

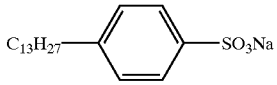

Compound 1

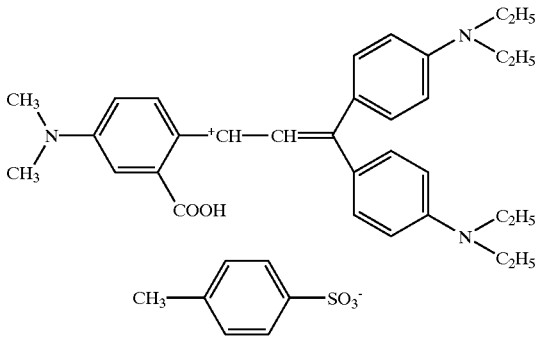

Compound 2

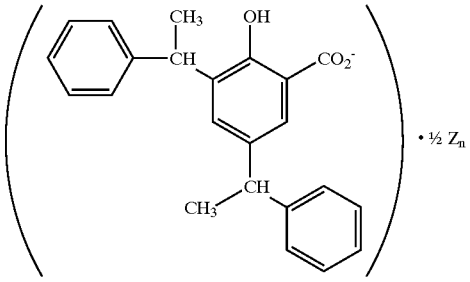

Compound 3

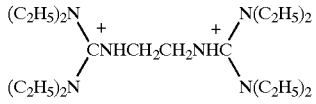

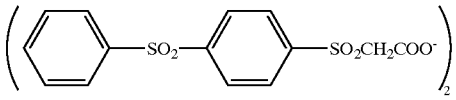

The photothermographic material samples were evaluated according to the following manner.

Evaluation of Photographic Performance

The photothermographic material samples of a size of 14×24 (in) were each divided into two groups and exposed to laser light using a 830 nm laser diode which was inclined at 13 degrees from the vertical plane, under the condition A or B:

Condition A: 23° C., 55% RH, 4 days

Condition B: 40° C., 80% RH, 4 days;

and the exposed photothermographic material samples were subjected to thermal development at 110° C. for 20 sec.

The thus obtained images were evaluated using a digital densitometer PDA-65 (available from Konica Corp.). Densitometry results were evaluated based on sensitivity. Sensitivity was represented by relative value of reciprocal of exposure necessary to a density of a fog density plus 0.3, based on the sensitivity of Sample 3-1 exposed under the condition A (SiA) being 100.

Variation of Sensitivity with Temperature on Exposure

The ratio of sensitivity ΔSp (=SCB/SiA) was used as a measure of variation of sensitivity with humidity on exposure, in which SiA is sensitivity of a sample exposed under the condition A and SCB is sensitivity of a sample exposed under the condition B. The ΔSp closer to 1 is less sensitivity variation, indicating being superior. Results are shown in Table 3.

TABLE 3

| Sample | Additive | Dye | Fog | SiA | ΔSp | Remark |
|---|---|---|---|---|---|---|
| 3-1 | SS-7 | Dye A<br>Dye B | 0.09 | 100 | 0.80 | Comp. |
| 3-2 | SS-8 | No. 22 | 0.10 | 103 | 0.84 | Comp. |
| 3-3 | 28 | No. 22 | 0.10 | 104 | 0.97 | Inv. |
| 3-4 | 36 | No. 22 | 0.09 | 104 | 0.99 | Inv. |
| 3-5 | 4 | No. 22 | 0.09 | 106 | 0.99 | Inv. |
| 3-6 | 10 | No. 22 | 0.09 | 112 | 0.99 | Inv. |
| 3-7 | 33 | No. 22 | 0.09 | 108 | 0.97 | Inv. |
| 3-8 | SS-7 | No. 46 | 0.10 | 103 | 0.84 | Comp. |
| 3-9 | SS-8 | No. 46 | 0.11 | 105 | 0.83 | Comp. |
| 3-10 | 28 | No. 46 | 0.09 | 107 | 0.98 | Inv. |
| 3-11 | 36 | No. 46 | 0.10 | 106 | 0.98 | Inv. |
| 3-12 | 4 | No. 46 | 0.09 | 110 | 0.98 | Inv. |
| 3-13 | 10 | No. 46 | 0.09 | 117 | 0.99 | Inv. |
| 3-14 | 33 | No. 46 | 0.10 | 109 | 0.99 | Inv. |

SS-7

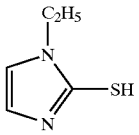

SS-8

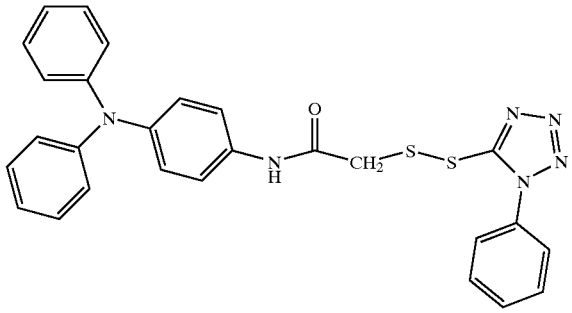

As apparent from Table 3, silver halide photothermographic materials according to the invention exhibited superior performance such as high sensitivity and reduced variation of sensitivity with humidity.

What is claimed is:

1. A silver halide emulsion comprising:

(a) at least a compound represented by the following formula (1), (2), (3) or (4):

formula (1)

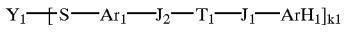

formula (2)

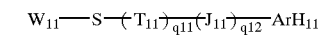

formula (3)

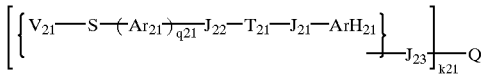

wherein $Y_1$ represents a hydrogen atom, a direct bond or an amidino group; $W_{11}$ represents a hydrogen atom, an aliphatic hydrocarbon group, an aryl group, a heterocyclic group or an amidino group; $V_{21}$ represents a hydrogen atom, an aliphatic hydrocarbon group, an aryl group, a heterocyclic group, RS group or an amidino group, in which R is an alkyl group, aryl group or a heterocyclic group; $T_1$ and $T_{21}$ each represent a bivalent aliphatic hydrocarbon linkage group or a direct bond; $T_{11}$ represents a bivalent liking group comprised of aliphatic hydrocarbon group; $J_1$, $J_2$, $J_{21}$, $J_{22}$ and $J_{23}$ each represent a bivalent linking group containing at least one of an oxygen atom, sulfur atom and nitrogen atom or a direct bond; $J_{11}$ represents a bivalent linking group containing at least one of an oxygen atom, sulfur atom and nitrogen atom; $Ar_1$ and $Ar_{21}$ each represent an aromatic hydrocarbon group; $ArH_1$, $ArH_{11}$ and $ArH_{21}$ each represent an aromatic hydrocarbon group or an aromatic heterocyclic group; k1 is an integer of 1 or 2; k21 is an integer of 2 to 4; $q_{11}$, $q_{12}$ and $q_{21}$ are each an integer of 0 and 1 and q11+q12≠0; Q represent a k21-valent linking group attached via the $J_{22}$ group to any one of $V_{21}$, $T_{21}$ and $ArH_{21}$;

formula (4)

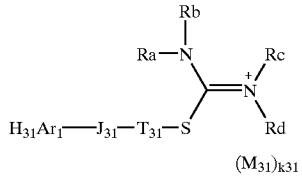

wherein $ArH_{31}$ represents an aromatic hydrocarbon group or an aromatic heterocyclic group; $T_{31}$ represents a bivalent aliphatic hydrocarbon linkage group or a direct bond; $J_{31}$ represents a bivalent linking group containing at least one of an oxygen atom, sulfur atom and nitrogen atom or a direct bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to neutralize an intramolecular charge; and $k_{31}$ represent the number of the ion necessary to neutralize an intramolecular charge; and (b) at least a compound represented by the following formula (S-1) or (S-2):

formula (S-1)

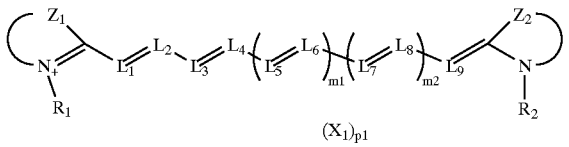

$(X_1)_{p1}$ formula (S-2)

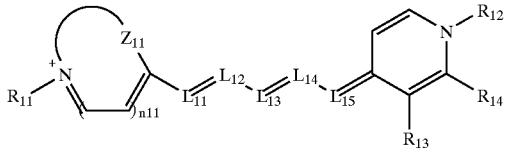

$(X_{11})_{p11}$ wherein $Z_1$, $Z_2$ and $Z_{11}$ each represent a nonmetallic atom necessary to form a 5- or 6-membered nitrogen containing heterocyclic ring; $L_1$ through $L_9$ and $L_{11}$ through $L_{15}$ each represent a methine group; $R_1$, $R_2$, $R_{11}$ and $R_{12}$ each represent an aliphatic group; $R_{13}$ and $R_{14}$ each represent a hydrogen atom, a substituent group or an atomic group necessary to form a condensed ring between $R_{13}$ and $R_{14}$; $X_1$ and $X_{11}$ each represent an ion necessary to balance with an intramolecular charge; p1 and p11 represent the number necessary to balance with an intramolecular charge; and m1, m2 and n11 are each an integer of 0 or 1.

2. The silver halide emulsion of claim 1, wherein the silver halide emulsion comprises a compound represented by formula (1), (2) or (3).

3. The silver halide emulsion of claim 1, wherein the silver halide emulsion comprises a compound represented by formula (4).

4. A silver halide light sensitive photographic material comprising a support having thereon at least a light sensitive layer containing a silver halide emulsion, wherein the silver halide emulsion comprises:

(a) at least a compound represented by the following formula (1), (2), (3) or (4):

formula (1)

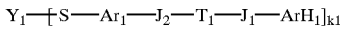

formula (2)

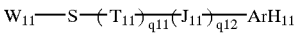

formula (3)

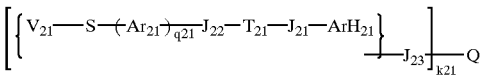

wherein $Y_1$ represents a hydrogen atom, a direct bond or an amidino group; $W_{11}$ represents a hydrogen atom, an aliphatic hydrocarbon group, an aryl group, a heterocyclic group or an amidino group; $V_{21}$ represents a hydrogen atom, an aliphatic hydrocarbon group, an aryl group, a heterocyclic group, RS group or an amidino group, in which R is an alkyl group, aryl group or a heterocyclic group; $T_1$ and $T_{21}$ each represent a bivalent aliphatic hydrocarbon linkage group or a direct bond; $T_{11}$ represents a bivalent liking group comprised of aliphatic hydrocarbon group; $J_1$, $J_2$, $J_{21}$, $J_{22}$ and $J_{23}$ each represent a bivalent linking group containing at least one of an oxygen atom, sulfur atom and nitrogen atom or a direct bond; $J_{11}$ represents a bivalent linking group containing at least one of an oxygen atom, sulfur atom and nitrogen atom; $Ar_1$ and $Ar_{21}$ each represent an aromatic hydrocarbon group; $ArH_1$, $ArH_{11}$ and $ArH_{21}$ each represent an aromatic hydrocarbon group or an aromatic heterocyclic group; k1 is an integer of 1 or 2; k21 is an integer of 2 to 4; $q_{11}$, $q_{12}$ and $q_{21}$ are each an integer of 0 and 1 and q11+q12≠0; Q represent a k21-valent linking group attached via the $J_{22}$ group to any one of $V_{21}$, $T_{21}$ and $ArH_{21}$;

formula (4)

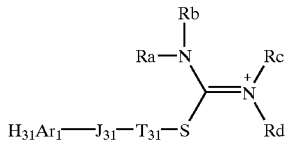

$(M_{31})_{k31}$ wherein $ArH_{31}$ represents an aromatic hydrocarbon group or an aromatic heterocyclic group; $T_{31}$ represents a bivalent aliphatic hydrocarbon linkage group or a direct bond; $J_{31}$ represents a bivalent linking group containing at least one of an oxygen atom, sulfur atom and nitrogen atom or a direct bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to neutralize an intramolecular charge; and $k_{31}$ represent the number of the ion necessary to neutralize an intramolecular charge; and (b) at least a compound represented by the following formula (S-1) or (S-2):

formula (S-1)

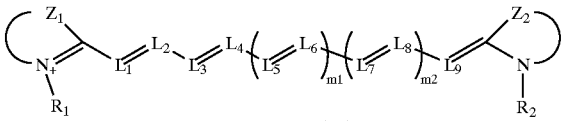

$(X_1)_{p1}$ formula (S-2)

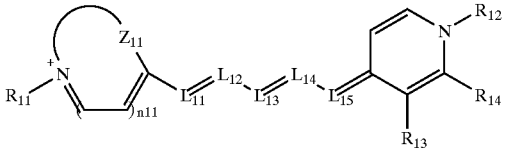

$(X_{11})_{p11}$ wherein $Z_1$, $Z_2$ and $Z_{11}$ each represent a nonmetallic atom necessary to form a 5- or 6-membered nitrogen containing heterocyclic ring; $L_1$ through $L_9$ and $L_{11}$ through $L_{15}$ each represent a methine group; $R_1$, $R_2$, $R_{11}$ and $R_{12}$ each represent an aliphatic group; $R_{13}$ and $R_{14}$ each represent a hydrogen atom, a substituent group or an atomic group necessary to form a condensed ring between $R_{13}$ and $R_{14}$; $X_1$ and $X_{11}$ each represent an ion necessary to balance with an intramolecular charge; p1 and p11 represent the number necessary to balance with an intramolecular charge; and m1, m2 and n11 are each an integer of 0 or 1.

5. The silver halide photographic material of claim 4, wherein the silver halide emulsion comprises a compound represented by formula (1), (2) or (3).

6. The silver halide photographic material of claim 4, wherein the silver halide emulsion comprises a compound represented by formula (4).

7. The silver halide photographic material of claim 4, wherein the light sensitive layer further comprises an organic silver salt and a reducing agent.

8. The silver halide photographic material of claim 7, wherein the silver halide emulsion comprises a compound represented by formula (1), (2) or (3).

9. The silver halide photographic material of claim 7, wherein the silver halide emulsion comprises a compound represented by formula (4).

10. A silver halide emulsion comprising:

(a) at least a compound represented by the following formula (4):

formula (4)

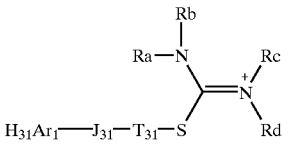

$(M_{31})_{k31}$ wherein $ArH_{31}$ represents an aromatic hydrocarbon group or an aromatic heterocyclic group; $T_{31}$ represents a bivalent aliphatic hydrocarbon linkage group or a direct bond; $J_{31}$ represents a bivalent linking group containing at least one of an oxygen atom, sulfur atom and nitrogen atom or a direct bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to neutralize an intramolecular charge; and $k_{31}$ represents the number of the ions necessary to neutralize an intramolecular charge;

(b) at least a compound represented by the following formula (S-1) or (S-2):

formula (S-1)

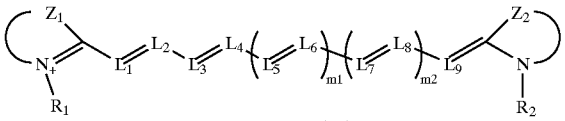

$(X_1)_{p1}$ formula (S-2)

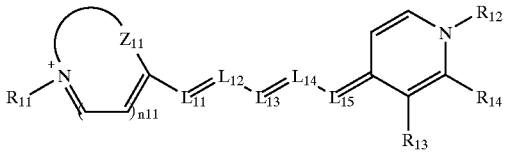

$(X_{11})_{p11}$ wherein $Z_1$, $Z_2$ and $Z_{11}$ each represent a nonmetallic atom necessary to form a 5- or 6-membered nitrogen containing heterocyclic ring; $L_1$ through $L_9$ and $L_{11}$ through $L_{15}$ each represent a methine group; $R_1$, $R_2$, $R_{11}$ and $R_{12}$ each represent an aliphatic group; $R_{13}$ and $R_{14}$ each represent a hydrogen atom, a substituent group or an atomic group necessary to form a condensed ring between $R_{13}$ and $R_{14}$; $X_1$ and $X_{11}$ each represent an ion necessary to balance with an intramolecular charge; p1 and p11 represent the number necessary to balance with an intramolecular charge; and m1, m2 and n11 are each an integer of 0 or 1.

11. A silver halide light sensitive photographic material comprising a support having thereon at least a light sensitive layer containing a silver halide emulsion, wherein the silver halide emulsion comprises (a) at least a compound represented by the following formula (4):

formula (4)

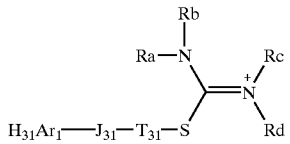

$(M_{31})_{k31}$ wherein $ArH_{31}$ represents an aromatic hydrocarbon group or an aromatic heterocyclic group; $T_{31}$ represents a bivalent aliphatic hydrocarbon linkage group or a direct bond; $J_{31}$ represents a bivalent linking group containing at least one of an oxygen atom, sulfur atom and nitrogen atom or a direct bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to neutralize an intramolecular charge; and k31 represents the number of the ions necessary to neutralize an intramolecular charge, (b) at least a compound represented by the following formula (S-1) or (S-2):

formula (S-1)

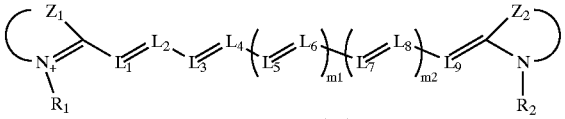

$(X_1)_{p1}$ formula (S-2)

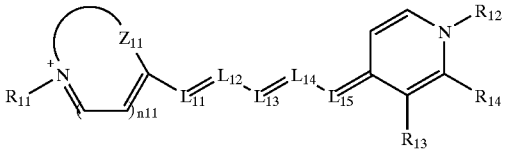

$(X_{11})_{p11}$ wherein $Z_1$, $Z_2$ and $Z_{11}$ each represent a nonmetallic atom necessary to form a 5- or 6-membered nitrogen containing heterocyclic ring; $L_1$ through $L_9$ and $L_{11}$ through $L_{15}$ each represent a methine group; $R_1$, $R_2$, $R_{11}$ and $R_{12}$ each represent an aliphatic group; $R_{13}$ and $R_{14}$ each represent a hydrogen atom, a substituent group or an atomic group necessary to form a condensed ring between $R_{13}$ and $R_{14}$; $X_1$ and $X_{11}$ each represent an ion necessary to balance with an intramolecular charge; p1 and p11 represent the number necessary to balance with an intramolecular charge; and m1, m2 and n11 are each an integer of 0 or 1.

12. The silver halide photographic material of claim 11, wherein the light sensitive layer further comprises an organic silver salt and a reducing agent.

* * * * *